US008874014B2

(12) United States Patent
Komatsu

(10) Patent No.: US 8,874,014 B2
(45) Date of Patent: Oct. 28, 2014

(54) IMAGE FORMING APPARATUS

(75) Inventor: Isao Komatsu, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 90 days.

(21) Appl. No.: 13/597,457

(22) Filed: Aug. 29, 2012

(65) Prior Publication Data

US 2013/0058686 A1 Mar. 7, 2013

(30) Foreign Application Priority Data

Sep. 6, 2011 (JP) ..... 2011-193899

(51) Int. Cl.

| | |
|---|---|
| ***G03G 15/16*** | (2006.01) |
| ***G03G 15/043*** | (2006.01) |
| ***G03G 15/02*** | (2006.01) |
| ***G03G 15/00*** | (2006.01) |
| ***G03G 15/01*** | (2006.01) |

(52) U.S. Cl.

CPC ..... *G03G 15/5041* (2013.01); *G03G 15/043* (2013.01); *G03G 15/0266* (2013.01); *G03G 2215/00059* (2013.01); *G03G 2215/0161* (2013.01); *G03G 15/011* (2013.01)

USPC ..... 399/301

(58) Field of Classification Search

CPC ..... G03G 15/0161

USPC ..... 399/301

See application file for complete search history.

(56) References Cited

U.S. PATENT DOCUMENTS

| | | | | | |
|---|---|---|---|---|---|
| 4,903,067 | A * | 2/1990 | Murayama et al. | ..... | 347/129 |
| 4,937,664 | A * | 6/1990 | Chiku et al. | ..... | 358/526 |
| 5,072,244 | A * | 12/1991 | Aoki et al. | ..... | 347/116 |
| 5,160,946 | A * | 11/1992 | Hwang | ..... | 347/116 |
| 5,384,592 | A * | 1/1995 | Wong | ..... | 347/116 |
| 5,631,686 | A * | 5/1997 | Castelli et al. | ..... | 347/133 |
| 6,275,244 | B1 * | 8/2001 | Omelchenko et al. | ..... | 346/116 |
| 6,300,968 | B1 * | 10/2001 | Kerxhalli et al. | ..... | 347/116 |
| 6,682,163 | B2 * | 1/2004 | Metzler et al. | ..... | 347/19 |
| 6,957,031 | B2 * | 10/2005 | Tomita et al. | ..... | 399/301 |
| 6,993,275 | B2 * | 1/2006 | Mitsuya et al. | ..... | 399/301 |
| 7,528,851 | B2 * | 5/2009 | Yoshida | ..... | 347/116 |
| 7,636,533 | B2 * | 12/2009 | Kikuchi et al. | ..... | 399/167 |
| 7,647,015 | B2 * | 1/2010 | Kubota et al. | ..... | 399/301 |

(Continued)

FOREIGN PATENT DOCUMENTS

| | | | | |
|---|---|---|---|---|
| JP | 1-142676 A | | 6/1989 | |
| JP | 5-188697 A | | 7/1993 | |
| JP | H05188697 | * | 7/1993 | ..... B41J 2/44 |

*Primary Examiner* — Clayton E Laballe
*Assistant Examiner* — Kevin Butler
(74) *Attorney, Agent, or Firm* — Fitzpatrick, Cella, Harper & Scinto

(57) ABSTRACT

An image forming apparatus, including: an image bearing member; a charging device configured to charge a surface of the image bearing member; a power source configured to apply a voltage to the charging device; an exposure device configured to irradiate the surface of the image bearing member with a light beam to form an electrostatic latent image; a developing device configured to develop the latent image into a toner image; and a reading device configured to read a color registration toner image obtained by developing, by the developing device, a color registration electrostatic latent image formed on the surface of the image bearing member by the exposure device within a period from a time when the power source is started up to apply the voltage to the charging device to a time when a potential of the surface of the image bearing member reaches a potential for usual image formation.

7 Claims, 23 Drawing Sheets

(56) References Cited

U.S. PATENT DOCUMENTS

| | | | | |
|---|---|---|---|---|
| 7,764,897 | B2 * | 7/2010 | Takezawa | 399/72 |
| 7,778,579 | B2 * | 8/2010 | Ueda et al. | 399/301 |
| 7,865,119 | B2 * | 1/2011 | Matsuyama et al. | 399/301 |
| 7,917,045 | B2 * | 3/2011 | Yagawara et al. | 399/38 |
| 8,059,145 | B2 * | 11/2011 | Ueda et al. | 347/116 |
| 8,245,638 | B2 * | 8/2012 | Petersen | 101/485 |
| 2007/0212086 | A1 * | 9/2007 | Yagawara et al. | 399/49 |
| 2007/0242980 | A1 * | 10/2007 | Kikuchi et al. | 399/167 |
| 2007/0274745 | A1 * | 11/2007 | Ueda et al. | 399/301 |
| 2008/0193165 | A1 * | 8/2008 | Nakazawa et al. | 399/167 |
| 2008/0253781 | A1 * | 10/2008 | Takezawa | 399/39 |
| 2013/0142549 | A1 * | 6/2013 | Itoh | 399/301 |

* cited by examiner

IMAGE FORMING APPARATUS

BACKGROUND OF THE INVENTION

1. Field of the Invention

The present invention relates to an image forming apparatus which performs color registration.

2. Description of the Related Art

In recent years, there has been an increasing market demand for multifunctional peripherals including a plurality of output terminals such as a copier, a printer, and a facsimile machine. In those output terminals, electrophotographic image forming apparatus are used widely.

In the case where an image forming portion is divided into a plurality of stations for respective colors in a color image forming apparatus, an image position formed in each station may be displaced in a process proceeding direction (hereinafter referred to as "sub scanning direction") or a longitudinal direction (hereinafter referred to as "main scanning direction"). This is called color misregistration, and the occurrence of the color misregistration leads to degradation in image quality. Factors for causing the color misregistration mainly include the deformation of an exposure device caused by a temperature change and the variation in a light irradiation position on the surface of an image bearing member resulting from the deformation. Although the color misregistration is within a certain range due to the accuracy of constituent components, color misregistration of about tens of to hundreds of μm may occur, depending on the deformation of a main body and an exposure device resulting from a rise in temperature in image formation.

In order to correct the color misregistration, a control mechanism configured to form a color registration pattern on the surface of an image bearing member, read the formed pattern with an optical sensor (registration detecting sensor), and perform color registration is mounted on a conventional product. For example, Japanese Patent Application Laid-Open Nos. H01-142676 and H05-188697 disclose a configuration of changing timing for performing color registration depending on a temperature change detected by a temperature sensor of a main body of an image forming apparatus, and a configuration of changing timing for performing color registration depending on an accumulated time period from power-on of the image forming apparatus.

In the conventional image forming apparatus, the color registration is performed after it becomes possible to form an ordinary image in usual image formation, and hence, first copy output time (FCOT) increases along with the color registration. The FCOT refers to a time period required from the start of an image forming process to the output of a transfer material on which an image is formed first. It is also important for increasing the speed of image formation to shorten the FCOT which increases along with the color registration.

SUMMARY OF THE INVENTION

The present invention shortens the FCOT compared with that of a conventional example.

According to an exemplary embodiment of the present invention, an image forming apparatus includes: an image bearing member; a charging device configured to charge a surface of the image bearing member; a power source configured to apply a voltage to the charging device; an exposure device configured to irradiate the surface of the image bearing member with a light beam to form an electrostatic latent image; a developing device configured to develop the electrostatic latent image into a toner image; and a reading device configured to read a color registration toner image obtained by developing, by the developing device, a color registration electrostatic latent image formed on the surface of the image bearing member by the exposure device, wherein the color registration electrostatic latent image is formed on the surface of the image bearing member by the exposure device within a period from a time when the power source is started up to apply the voltage to the charging device to a time when a potential of the surface of the image bearing member reaches a potential for usual image formation.

Further features of the present invention will become apparent from the following description of exemplary embodiments with reference to the attached drawings.

BRIEF DESCRIPTION OF THE DRAWINGS

FIG. 1 is a graph showing a DC voltage $V_{dev}$ of a developing bias voltage and a surface potential $V_d$ in a non-exposure portion of a photosensitive drum in an image forming apparatus depending on lapsed time from when an output signal of a charging high voltage source is turned on.

FIGS. 7A and 7B are graphs showing a change in an output with lapsed time from when an output signal of a charging bias voltage in the first embodiment is turned on.

FIGS. 8A and 8B are graphs showing a change in an output with lapsed time from when an output signal of the developing bias voltage in the first embodiment is turned on.

FIG. 22 is a graph showing a change in a DC voltage $V_{dev}$ of a developing bias voltage and a surface potential $V_d$ in a non-exposure portion of the photosensitive drum 1 according to the first embodiment with respect to lapsed time from when an output signal of a charging high voltage source 101 is turned on.

DESCRIPTION OF THE EMBODIMENTS

Preferred embodiments of the present invention will now be described in detail in accordance with the accompanying drawings.

Figure 1:
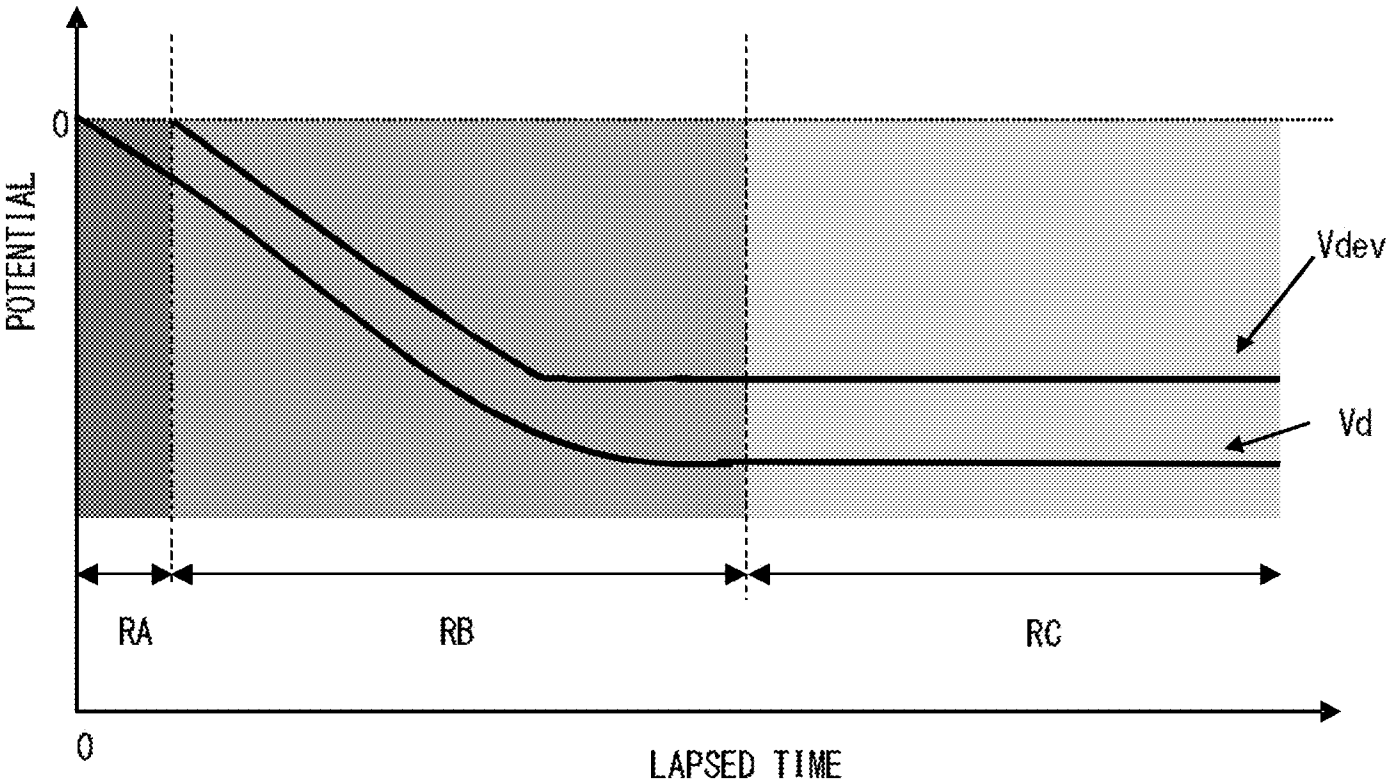

FIG. 1 is a graph showing a DC voltage $V_{dev}$ of a developing bias voltage and a surface potential $V_d$ in a non-exposure portion of a photosensitive drum that is an image bearing member in an image forming apparatus depending on lapsed time from when an output signal of a charging high voltage source that is a charging bias voltage application unit is turned on. As described later, the surface potential $V_d$ exhibits substantially the same change as in a charging bias voltage generated by the charging high voltage source.

In a region RA immediately after the charging high voltage source configured to apply a voltage to a charging roller 2 is started up (lapsed time=0), the DC voltage $V_{dev}$ has not been output yet, and thus, development cannot be performed. On the other hand, in a region RC, the surface potential $V_d$ and the DC voltage $V_{dev}$ respectively have reached potentials at which an ordinary image can be formed. In a region RB, the surface potential $V_d$ and the DC voltage $V_{dev}$ respectively have not reached potentials at which an ordinary image can be formed. Specifically, in the case of, in the region RB, forming a latent image by exposing the surface of the photosensitive drum at a laser exposure amount used in usual image formation and developing the formed latent image, the toner density of the developed image becomes lower than that of the ordinary image.

In the conventional image forming apparatus, color registration is performed in the region RC of FIG. 1. Specifically, in order to form a color registration toner pattern that is a color registration toner image, the pattern is developed with a toner density equal to that for usual image formation. However, it is only necessary to know timing of an exposure portion and a non-exposure portion on the basis of the color registration toner pattern.

In the image forming apparatus of the embodiment, in the region RB in which a toner density (0.3 or more, as described later) that enables a registration detecting sensor to measure timing of an exposure portion and a non-exposure portion sufficiently can be output, a color registration toner pattern is formed. After that, the formed pattern is read with the registration detecting sensor, and color registration is performed.

Accordingly, a time period required from when the output signal of the charging high voltage source is turned on till when the color registration is completed can be shortened, and consequently, the FCOT can be reduced.

First Embodiment

Next, color registration performed in an image forming apparatus according to a first embodiment will be described.

Figure 2:
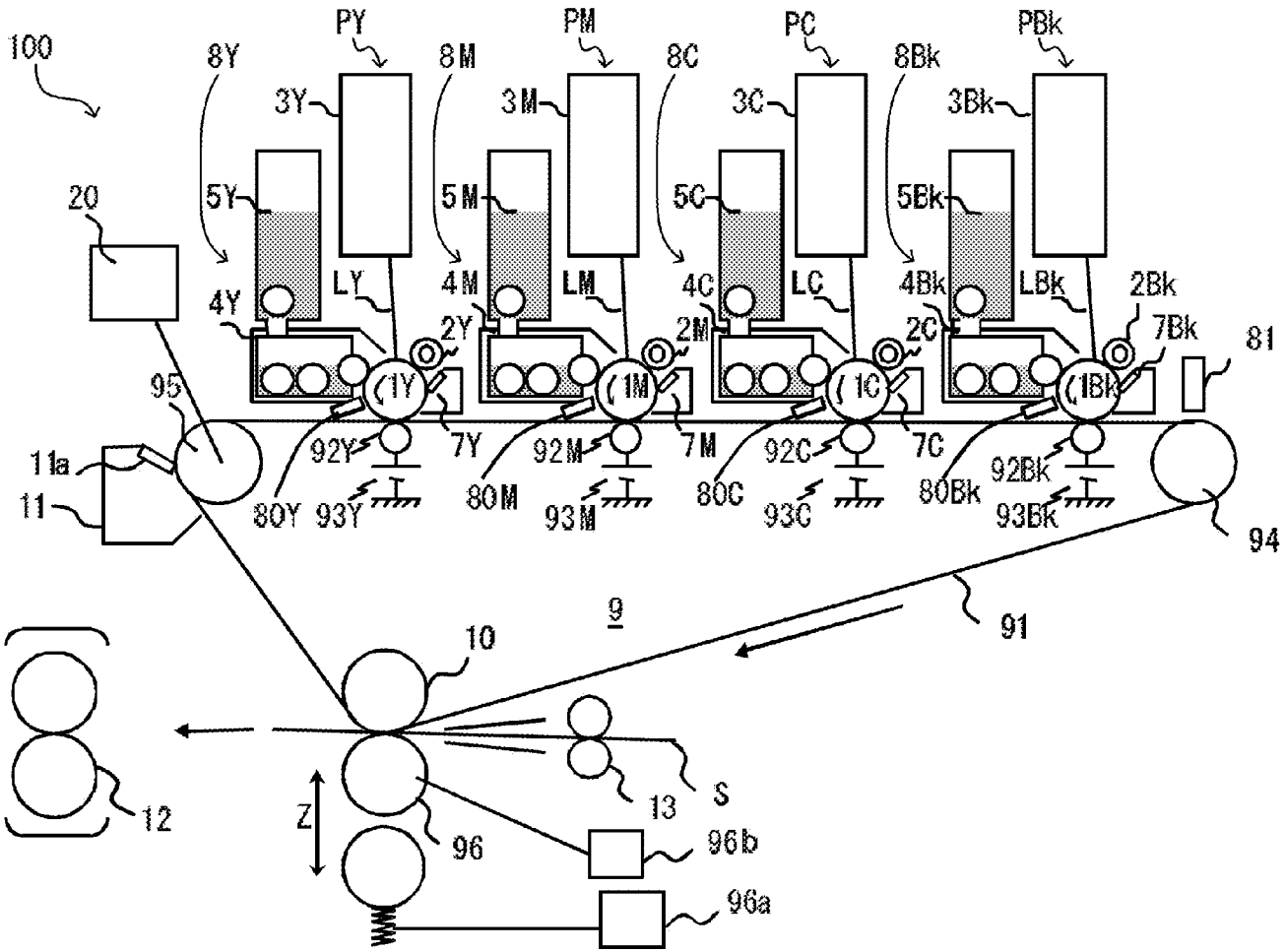
FIG. 2 is a diagram schematically illustrating structural elements in an image forming apparatus 100 according to a first embodiment.

FIG. 2 is a diagram schematically illustrating structural elements in an image forming apparatus 100 according to the first embodiment.

The image forming apparatus 100 of the embodiment is, for example, a color laser printer having a resolution of 600 dpi, which uses an electrophotographic process of an intermediate transfer member system, a contact charging system, and a two-component developing system and in which a maximum sheet size of a sheet to be supplied is A3. Thus, the image forming apparatus 100 of the embodiment can form a color image, for example, on a transfer material such as a copying paper or an OHP sheet, based on image information from an external host device (not shown) connected to a main body of an image forming apparatus so as to communicate therewith, and output the color image. The image forming apparatus 100 is an image forming apparatus of a four-station tandem drum type including four image forming portions PY, PM, PC, and PBk corresponding to yellow (Y), magenta (M), cyan (C), and black (Bk). The four image forming portions PY, PM, PC, and PBk include process cartridges 8Y, 8M, 8C, and 8Bk, respectively. The image forming portions PY, PM, PC, and PBk of the respective colors (Y, M, C, and Bk) of the image forming apparatus 100 have the same configuration except that colors of developers to be used are different, and hence reference symbols Y, M, C, and Bk may be omitted hereinafter for simplicity. The respective process cartridges 8 continuously multi-transfer toner images to an intermediate transfer belt 91 that is an intermediate transfer member, and the toner images are collectively transferred onto a transfer material S, and hence a color print image can be obtained. As illustrated in FIG. 2, the process cartridges 8 are arranged at an interval of 102 mm in the order of Y, M, C, and Bk in series in a movement direction of the intermediate transfer belt 91. The intermediate transfer belt 91 is passed over an intermediate transfer belt drive roller 95, an intermediate transfer belt driven roller 94, and a secondary transfer roller 10. An intermediate transfer belt drive unit 20 rotates the intermediate transfer belt drive roller 95 to rotate the intermediate transfer belt 91 in a clockwise direction indicated by an arrow of FIG. 2.

In each process cartridge 8, the surface of an electrophotographic photosensitive member (photosensitive drum 1)

having a photosensitive layer of an organic material on a conductive support is uniformly charged by the charging roller 2 that is a charging device. The surface of the uniformly charged photosensitive drum 1 is scanned and exposed by a laser beam (light beam) L radiated from an exposure device 3, and hence an electrostatic latent image is formed on the photosensitive drum 1. Toner that is a developer is allowed to adhere to the formed electrostatic latent image by a developing device 4, and the electrostatic latent image is developed into a toner image. A toner image of each color formed on each photosensitive drum 1 is transferred onto the moving intermediate transfer belt 91 so as to be successively superimposed by a primary transfer roller 92 that is a first transfer device.

Then, the color toner images formed on the intermediate transfer belt 91 are collectively transferred onto a conveyed transfer material S in a secondary transfer nip portion of a second transfer device comprised of the secondary transfer roller 10 and a secondary transfer outer roller 96 opposing each other. The secondary transfer outer roller 96 is provided so as to be contactable to or separable from the intermediate transfer belt 91 in a direction indicated by the arrow Z. A secondary transfer outer roller contact-separation mechanism 96*a* is controlled by a CPU 103 (not shown). The transfer material S on which the color toner images have been collectively transferred is conveyed to a fixing device 12 and delivered out of the apparatus after the toner images are fixed to the transfer material S. The image forming apparatus 100 also includes a cleaning blade 7, a cleaning blade 11*a*, an on-photosensitive-drum registration detecting sensor 80 that is a first reading device, and an on-intermediate-transfer-belt registration detecting sensor 81 that is a second reading device, which will be described later.

Figure 3:
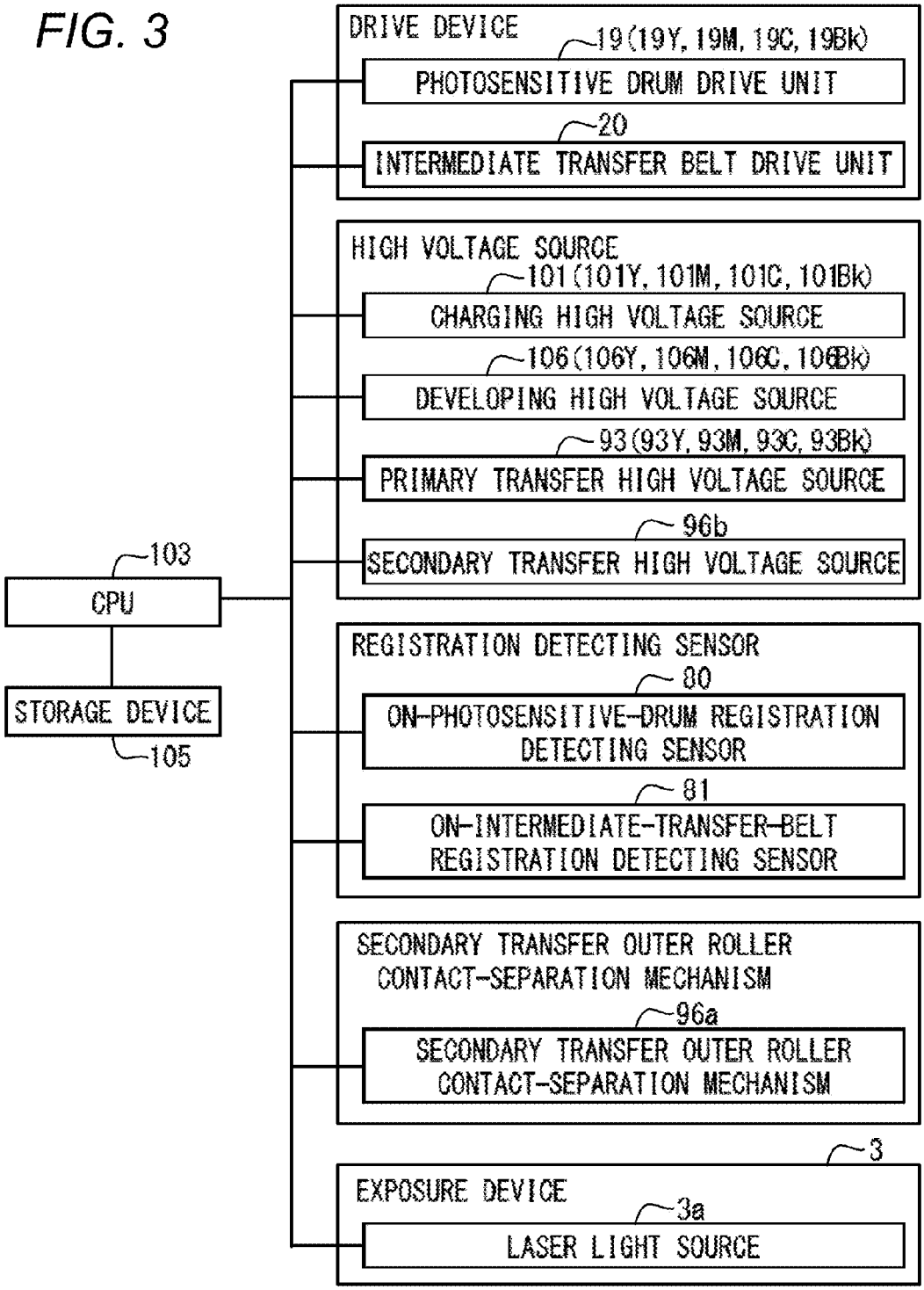
FIG. 3 is a block diagram illustrating a control configuration of the image forming apparatus 100 according to the first embodiment.

FIG. 3 is a block diagram illustrating a control configuration of the image forming apparatus 100 according to the first embodiment. As illustrated in FIG. 3, the CPU 103 is connected to a storage device 105 configured to store and read information. The CPU 103 is also connected to a photosensitive drum drive unit 19 for each photosensitive drum 1 and the intermediate transfer belt drive unit 20 for the intermediate transfer belt 91 so as to provide instructions of drive and suspension. Further, the CPU (first control device) 103 is connected to a charging high voltage source (charging bias voltage application unit) 101 configured to apply a voltage to each charging roller 2 so as to provide instructions of setting an output value, output, and suspension. The CPU (first control device) 103 is connected to a developing high voltage source (developing bias voltage application unit) 106 configured to apply a voltage to a developing sleeve 41 so as to provide instructions of setting an output value, output, and suspension. Further, the CPU 103 is connected to each primary transfer high voltage source 93 and a secondary transfer high voltage source 96*b* so as to provide instructions of setting an output value, output, and suspension. The CPU 103 is connected to the secondary transfer outer roller contact-separation mechanism 96*a* configured to control the contact and separation of the secondary transfer outer roller 96 so as to control the secondary transfer outer roller contact-separation mechanism 96*a*. The CPU 103 is connected to the respective on-photosensitive-drum registration detecting sensors 80 for the photosensitive drums 1Y, 1M, 1C, and 1Bk and the on-intermediate-transfer-belt registration detecting sensor so as to read output values of the respective on-photosensitive-drum registration detecting sensors 80 and the on-intermediate-transfer-belt registration detecting sensor 81 and control a light amount. Further, the CPU 103 is connected to respective laser light sources 3*a* of the exposure devices 3Y, 3M, 3C, and 3Bk so as to control the respective laser light sources 3*a*.

Next, each structural element of the image forming portion P will be described in detail with reference to FIG. 4.

Figure 4:
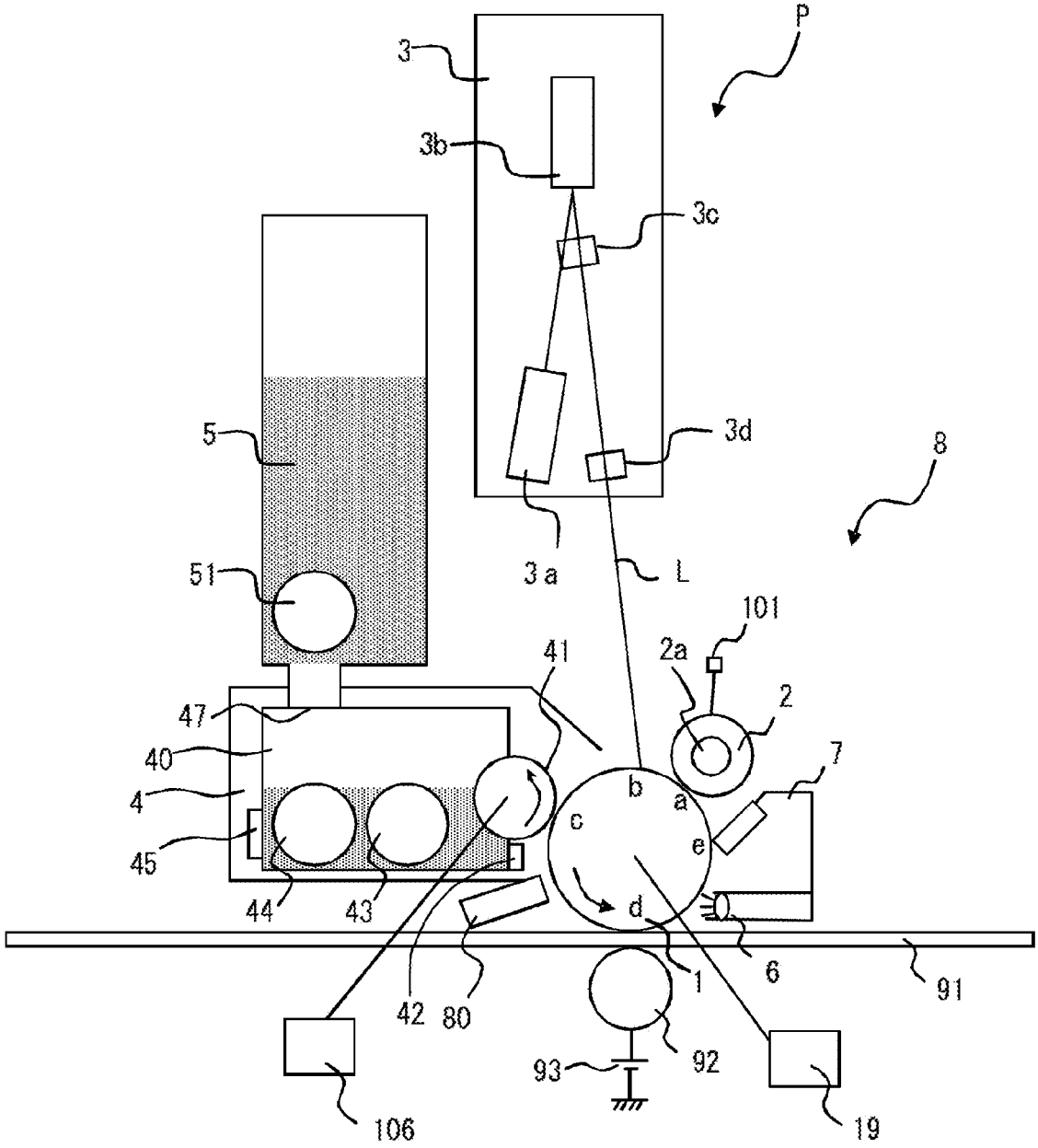
FIG. 4 is a diagram schematically illustrating a process cartridge 8 and structural elements in the vicinity thereof provided in an image forming portion P of the image forming apparatus 100 according to the first embodiment.

FIG. 4 is a diagram schematically illustrating the process cartridge 8 and structural elements in the vicinity thereof provided in the image forming portion P of the image forming apparatus 100 according to the first embodiment. The process cartridge 8 integrally includes the photosensitive drum 1, the charging roller 2, the developing device 4, and the cleaning blade 7 and is detachably mounted to the image forming apparatus 100. A developer cartridge 5 contains a developer (toner) to be supplied to the process cartridge 8 and is detachably mounted to the image forming apparatus 100. The toner in the developer cartridge 5 is supplied to a developing frame of the developing device 4 through a supply port 47 provided in the developing frame 40 by a supply screw 51. The toner in the developing frame 40 is agitated by an agitating member 44. The toner is supplied to the developing sleeve 41 by a supply member 43. The toner on the developing sleeve 41 is uniformly regulated by a toner regulating member 42. The developing frame 40 includes a toner remaining amount detector 45 configured to detect the residual amount of the toner in the developing frame 40.

The image forming apparatus 100 includes the photosensitive drum 1 of a rotary drum type. For example, the outer diameter of the photosensitive drum 1 of the embodiment is 30 mm and the length thereof is 360 mm. Further, the photosensitive drum 1 of the embodiment is, for example, an organic photoconductive (OPC) drum formed by coating the outer circumferential surface of a grounded drum base made of a conductive material such as aluminum with a photosensitive layer made of an ordinary OPC layer. The photosensitive drum 1 is rotated and driven in a counterclockwise direction at a process speed (circumferential velocity) of, for example, 300 mm/sec about a center spindle by the photosensitive drum drive unit 19 (DC brushless motor).

In the image forming apparatus 100 of the embodiment, the charging roller 2 that is a contact charger is used. The length of the charging roller 2 is, for example, 320 mm. The charging roller 2 is driven to rotate in association with the rotation of the photosensitive drum 1.

The charging roller 2 is supplied with a charging bias voltage by the charging high voltage source 101. In the embodiment, a cored bar 2*a* of the charging roller 2 is supplied with a voltage in which a DC component (DC voltage $V_{dc}$) and an AC component of a sine wave (AC voltage (peak-to-peak voltage) $V_{ac}$, frequency $f_{pri}$) are superimposed on each other as the charging bias voltage. This is because the superimposed voltage is not easily influenced by the contamination from an external additive of a surface layer of the charging roller 2, compared with the configuration in which only the DC voltage $V_{dc}$ is applied. The surface potential $V_d$ of a non-exposure portion of the photosensitive drum 1 converges on a potential of the DC voltage $V_{dc}$ in the case where the AC voltage $V_{ac}$ equal to or higher than a threshold voltage $V_{th}$ (discharge start voltage) is applied to the charging roller 2. In the embodiment, the threshold voltage $V_{th}$ is about 1,350 $V_{pp}$, for example, in an environment of a temperature of 23° C. and a humidity of 50%. In this case, $V_{pp}$ indicates a potential difference (peak-to-peak voltage) between an upper peak and a lower peak of an AC voltage in Volts. The charging high voltage source 101 is designed so as to apply a charging bias voltage having, for example, a DC voltage $V_{dc}$ of −500 V, an AC voltage $V_{ac}$ of 1,500 $V_{pp}$, and a frequency $f_{pri}$ of 1,750 Hz to the charging roller 2. Thus, the photosensitive drum 1 can be uniformly charged at the surface potential $V_d$ of −500 V.

The photosensitive drum 1 is irradiated with the laser beam L from the exposure device 3 after the photosensitive drum 1 is uniformly charged to a predetermined polarity and a potential by the charging roller 2 as described above. The exposure device 3 includes imaging optics and scanning optics configured to output a laser beam modulated according to a time-series electric digital pixel signal of image information. Thus, an electrostatic latent image corresponding to each color component of an intended color image is formed on a corresponding photosensitive drum 1.

In the embodiment, a laser beam scanner (light scanning apparatus) using a semiconductor laser is used as the exposure device 3. The exposure device 3 outputs the laser beam (light beam) L modulated according to an image signal, from the laser light source 3*a*. The output laser beam L is deflected by a rotary polygon mirror 3*b* and passes through lenses 3*c* and 3*d* to radiate the uniformly charged surface of the rotating photosensitive drum 1. Specifically, the photosensitive drum 1 is scanned and exposed by a laser. The surface potential of the photosensitive drum 1 irradiated with the laser beam L changes from $V_d$ to $V_L$. Specifically, an electrostatic latent image corresponding to image information is formed on the surface of the rotating photosensitive drum 1.

Figure 5:
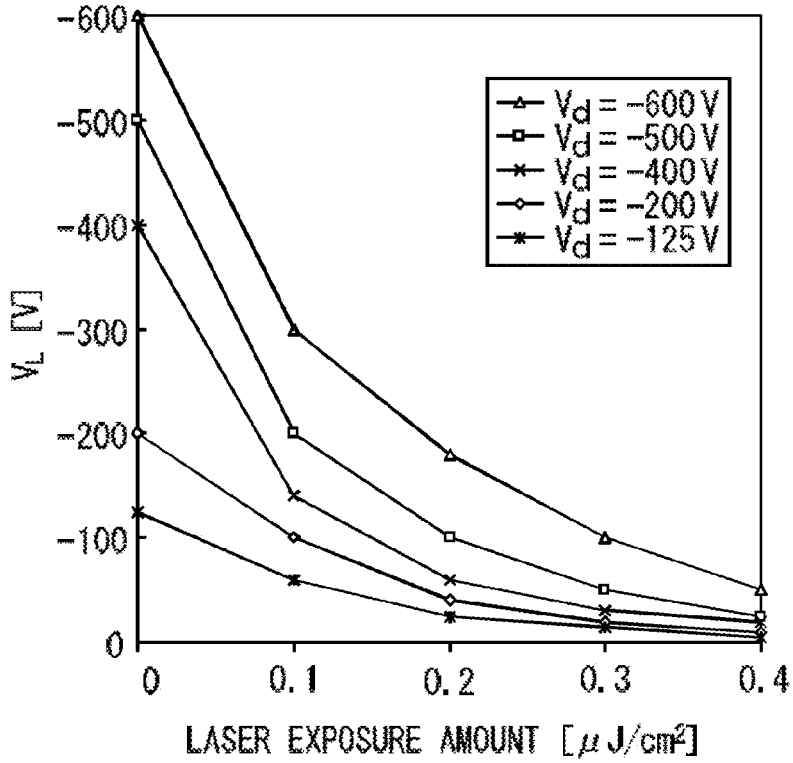
FIG. 5 is a graph showing a relationship between a laser exposure amount and a surface potential $V_L$ of an exposure portion of a photosensitive drum 1 provided in the image forming apparatus 100 according to the first embodiment at each surface potential $V_d$ of a non-exposure portion of the photosensitive drum 1.

The irradiation position of the laser beam L with respect to the photosensitive drum 1 is an exposure position "b". In the embodiment, the laser exposure amount varies, for example, in a range of 0.1 to 0.4 μJ/cm$^2$. The surface potential $V_L$ in the exposure position "b" of the photosensitive drum 1 after laser scanning and exposure can be changed in a range of about −20 V to about −300 V by a combination of the surface potential $V_d$ of the non-exposure portion and the laser exposure amount. FIG. 5 shows a relationship between the surface potential $V_L$ of the exposure portion and the laser exposure amount when the surface potential $V_d$ of the non-exposure portion is changed.

Toner is allowed to adhere to the electrostatic latent image formed on the photosensitive drum 1 by the developing device 4, and the electrostatic latent image is developed into a toner image. In the embodiment, as the developing device 4, a two-component contact developing device (two-component magnetic brush developing device) is used. The developing sleeve 41 of the developing device 4 is supplied with a developing bias voltage from the developing high voltage source 106. The developing bias voltage to be applied is obtained by superimposing a DC component (DC voltage $V_{dev}$) and an AC component of a rectangular wave (AC voltage (peak-to-peak voltage) $V_{dev_ac}$, frequency $f_{dev}$) on each other.

Figure 6:
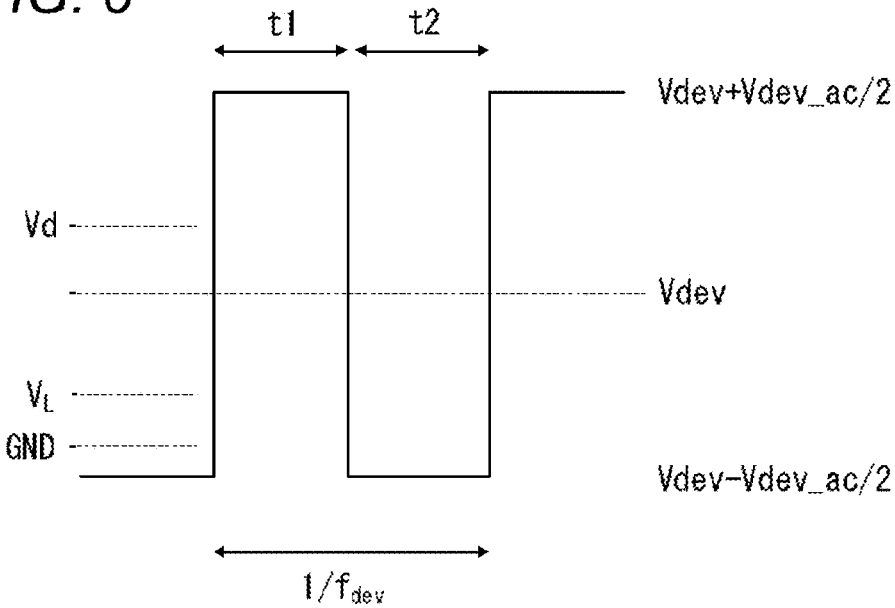
FIG. 6 is a diagram illustrating a waveform of the developing bias voltage in the first embodiment.

FIG. 6 illustrates a waveform of the developing bias voltage to be applied. As seen from FIG. 6, a developing bias voltage of $V_{dev}+V_{dev_ac}/2$ larger than $V_d$ is applied to the developing sleeve 41 during a time period t1, and a developing bias voltage of $V_{dev}-V_{dev_ac}/2$ smaller than $V_L$ is applied to the developing sleeve 41 during a time period t2. These applications of the voltages are repeated. Specifically, during the time period t1, an electric field is formed from the developing sleeve 41 to the photosensitive drum 1, and hence toner particles are transferred onto the photosensitive drum 1. On the other hand, during the time period t2, an electric field is formed from the photosensitive drum 1 to the developing sleeve 41, and hence the toner particles having transferred onto the photosensitive drum 1 return to the developing sleeve 41 (reverse transfer). Due to the alternate electric field, the transfer and the reverse transfer of the toner particles are repeated between the developing sleeve 41 and the photosensitive drum 1, and thus, a developing process proceeds.

The developing high voltage source 106 in the embodiment is designed so as to apply a developing bias voltage having, for example, a DC voltage $V_{dev}$ of −300 V, an AC voltage $V_{dev_ac}$ of 1,500 $V_{pp}$, and a frequency $f_{dev}$ of 12 kHz to the developing sleeve 41.

Figure 7A:
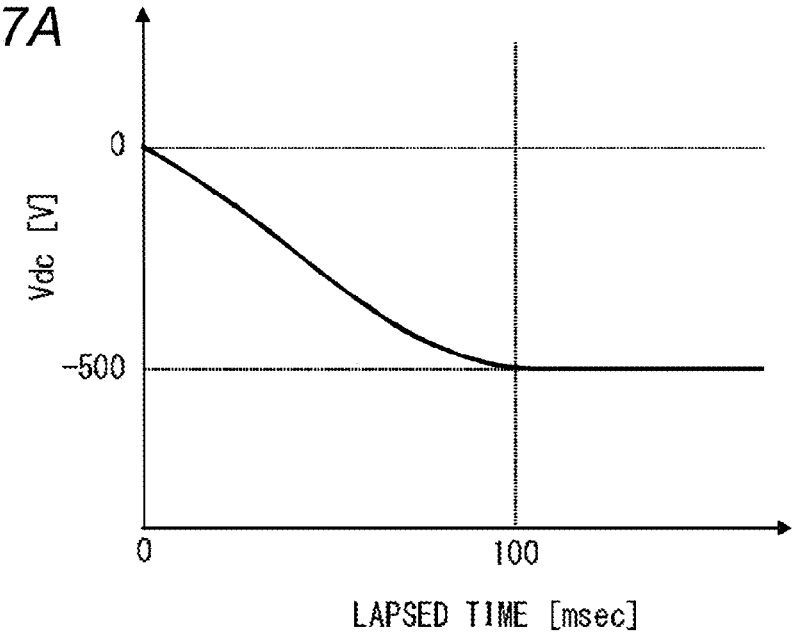
Figure 7B:
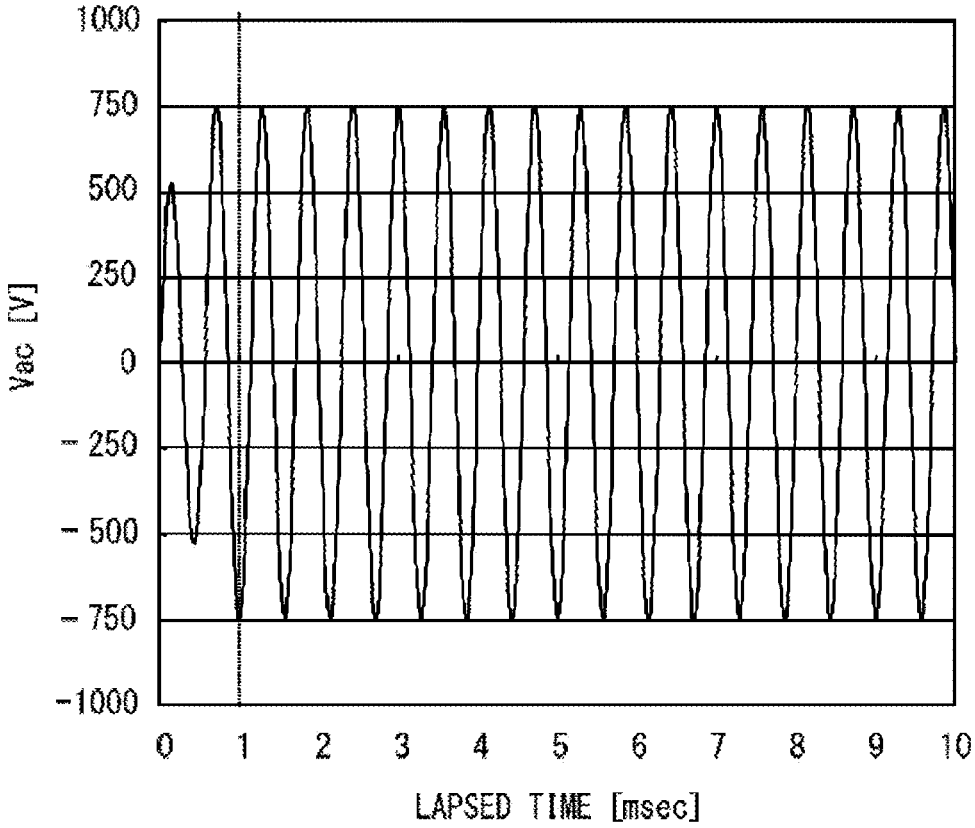
Figure 8A:
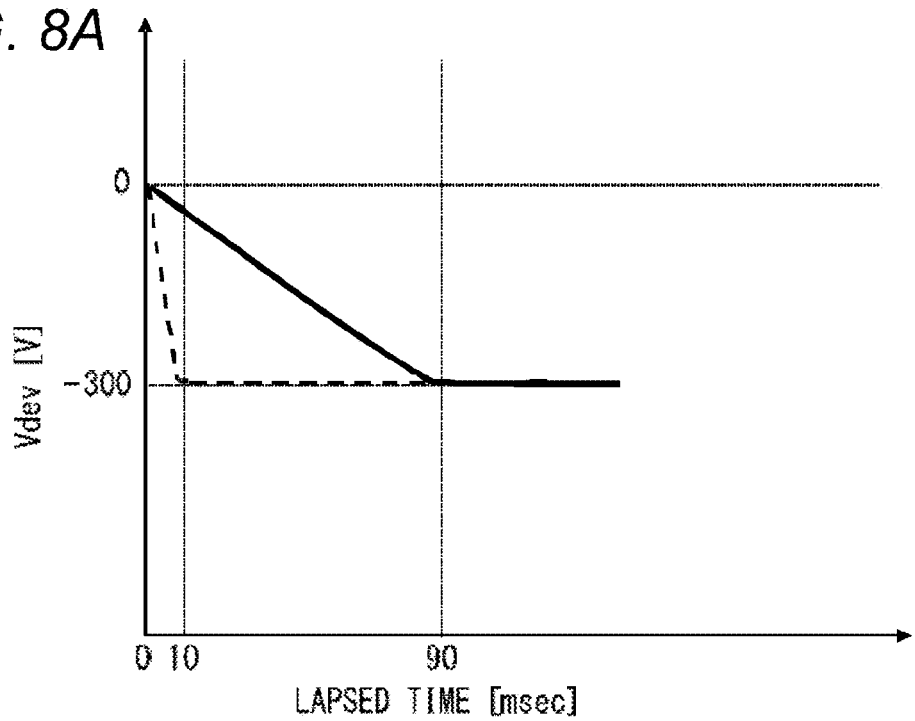
Figure 8B:
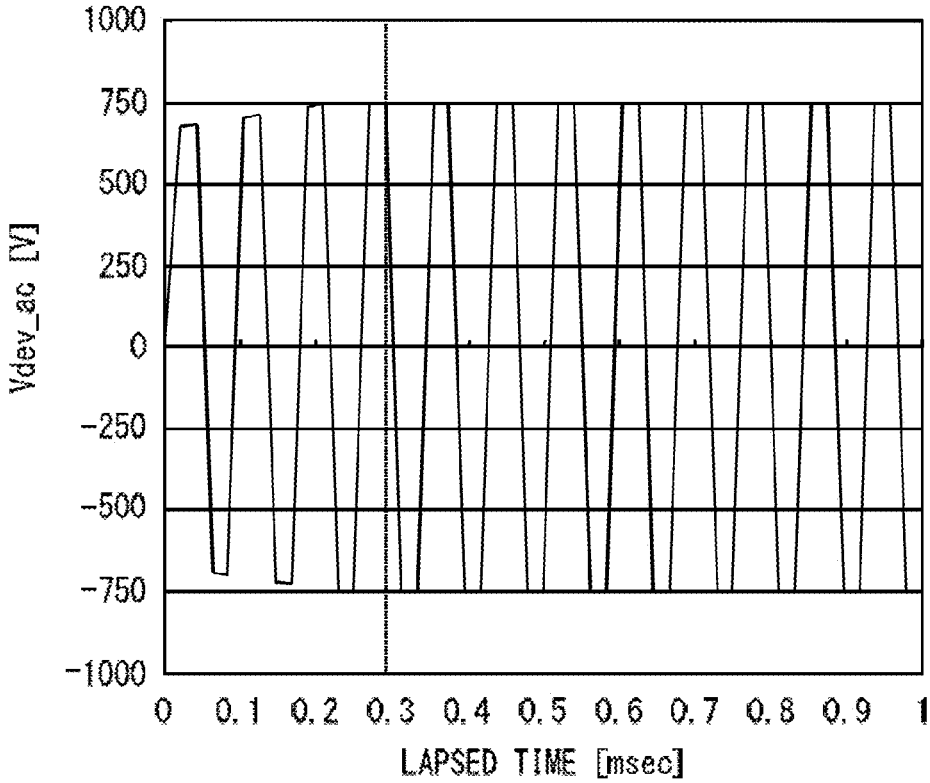

In this case, output values of the charging high voltage source 101 and the developing high voltage source 106 do not reach target values immediately even when an output signal is turned on. FIGS. 7A and 7B are graphs showing a change in an output with lapsed time from when an output signal of a charging bias voltage in the embodiment is turned on. FIG. 7A is a graph showing a change in an output with lapsed time from when an output signal of the DC voltage $V_{dc}$ of a charging bias voltage is turned on. FIG. 7B is a graph showing a change in an output with lapsed time from when an output signal of the AC voltage $V_{ac}$ of a charging bias voltage is turned on. Further, FIGS. 8A and 8B are graphs showing a change in an output with lapsed time from when an output signal of the developing bias voltage in the embodiment is turned on. FIG. 8A is a graph showing a change in an output with lapsed time from when an output signal of the DC voltage $V_{dev}$ of a developing bias voltage is turned on. FIG. 8B is a graph showing a change in an output with lapsed time from when an output signal of the AC voltage $V_{dev_ac}$ of a developing bias voltage is turned on.

It is understood that, at any voltage, it takes a time to obtain a desired output from when an output signal is turned on (lapsed time=0). In this case, regarding a DC voltage, a time period required for the DC voltage to reach a predetermined value is referred to as a rising time, and regarding an AC voltage, a time period required for an oscillation voltage at a predetermined value to be output by one period is referred to as a rising time. In contrast, a time period required for a voltage to reach zero (0) from when an output signal is turned off after the voltage rises is referred to as a falling time. In the embodiment, as seen from FIGS. 7A, 7B, 8A, and 8B, the rising times of the DC voltage $V_{dc}$ and the AC voltage $V_{ac}$ of the charging bias voltage, and the rising time of the AC voltage $V_{dev_ac}$ of the developing bias voltage are 100 milliseconds (hereinafter referred to as "msec"), 1 msec, and 0.3 msec, respectively. Note that, although the rising time of the DC voltage $V_{dev}$ of the developing bias voltage is generally 10 msec, the rising time may be delayed on purpose to be 90 msec so as to be matched with the rising time of the DC voltage $V_{dc}$ of the charging bias voltage.

Figure 9A:
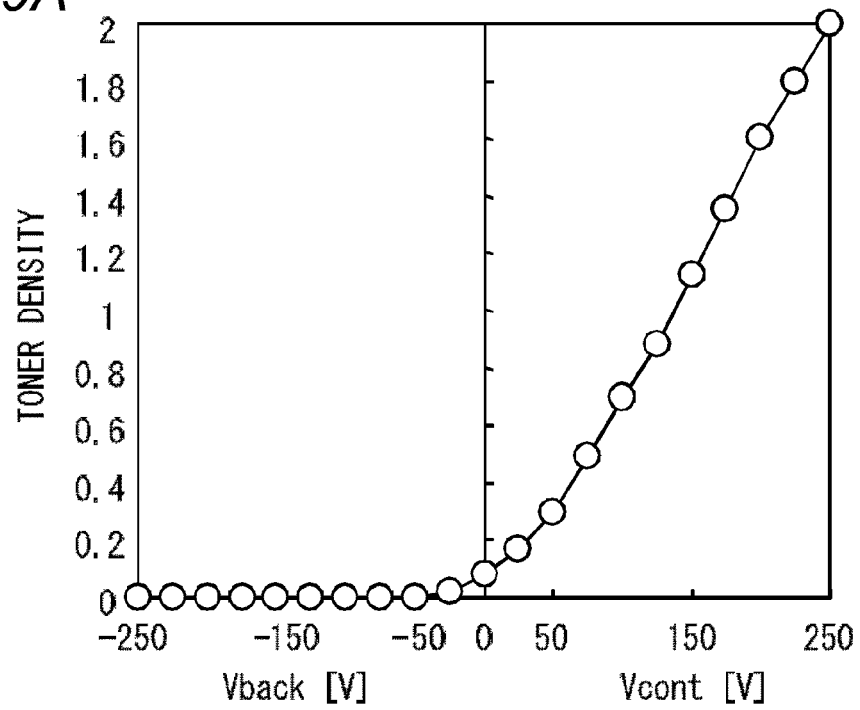
FIGS. 9A and 9B are graphs showing a toner density and the number of adhering carriers which depend on a fog removal voltage.
Figure 9B:
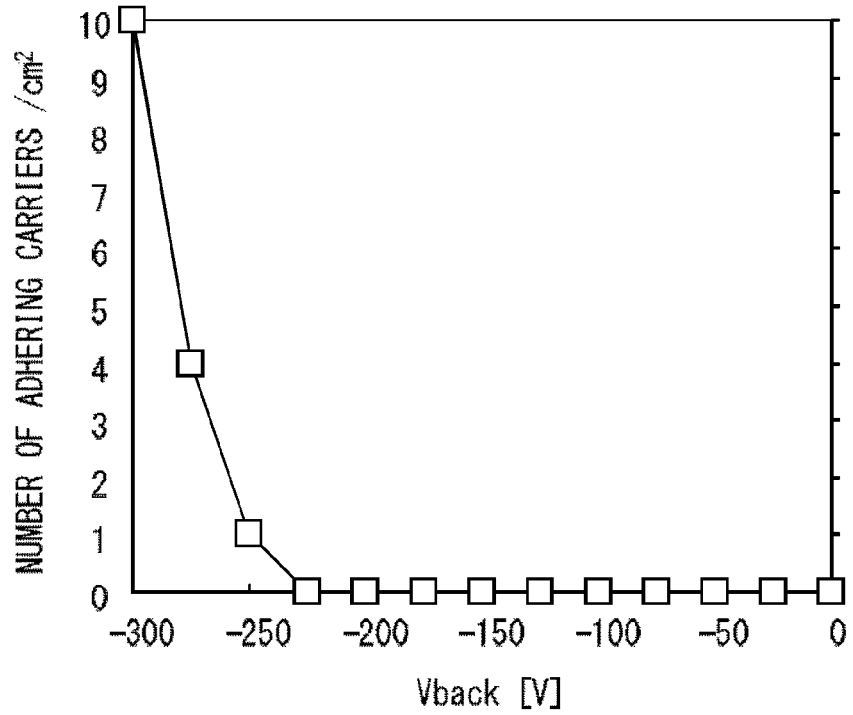

FIGS. 9A and 9B are graphs showing a toner density and the number of adhering carriers which depend on a fog removal voltage. FIG. 9A is a graph showing a toner density dependent on a contrast potential $V_{cont}$ and a fog removal potential $V_{back}$ in the embodiment. In this case, the contrast potential $V_{cont}$ is a value obtained by subtracting the DC voltage $V_{dev}$ of a developing bias voltage from the surface potential $V_L$ of a portion (exposure portion) of the photosensitive drum 1 irradiated with the laser beam L, i.e., $V_L-V_{dev}$. Further, the fog removal potential $V_{back}$ is a value obtained by subtracting the surface potential $V_d$ of a portion (non-exposure portion) of the photosensitive drum 1, which is not irradiated with the laser beam L, from the DC voltage $V_{dev}$ of the developing bias voltage, i.e., $V_{dev}-V_d$. Specifically, "fogging" means that toner is developed in a non-exposure portion. In the image forming apparatus 100 according to the first embodiment of the present invention, a maximum toner density at which an image can be formed is 1.5, and hence, it is understood from FIG. 9A that an electrostatic latent image on the photosensitive drum 1 can be developed at a toner density sufficient for forming an image when the contrast potential $V_{cont}$ is about 200 V. Further, it is understood from FIG. 9A that fogging does not occur when the fog removal potential $V_{back}$ is equal to or less than −50 V.

When a developer adheres to the exposure portion of the photosensitive drum 1, the electrostatic latent image on the photosensitive drum 1 is developed into a toner image. As the developer in the embodiment, a developer obtained by mixing toner with a carrier at a weight ratio of 8:92 is used. As the toner, negatively charged toner having an average particle diameter of 5.5 μm is used, and as the carrier, a magnetic carrier having a saturation magnetization of 205 emu/cm$^3$ and an average particle diameter of 35 μm is used.

FIG. 9B is a graph showing the number of adhering carriers on the surface of the photosensitive drum 1 depending on the fog removal potential $V_{back}$ in the embodiment. As seen from FIG. 9B, a carrier is not developed on the surface of the photosensitive drum 1 as long as the fog removal potential $V_{back}$ is equal to or higher than −200 V.

Figure 10A:
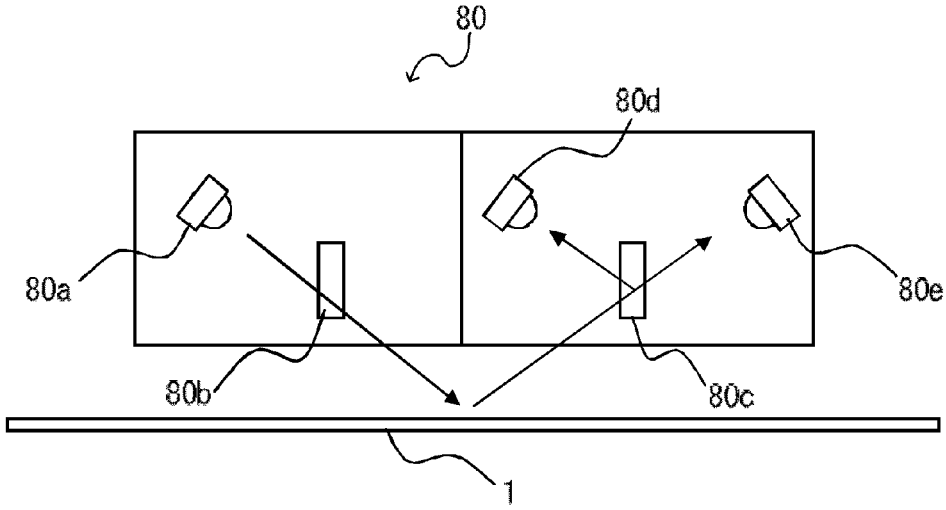
FIGS. 10A and 10B illustrate an on-photosensitive-drum registration detecting sensor 80 according to the first embodiment.
Figure 10B:
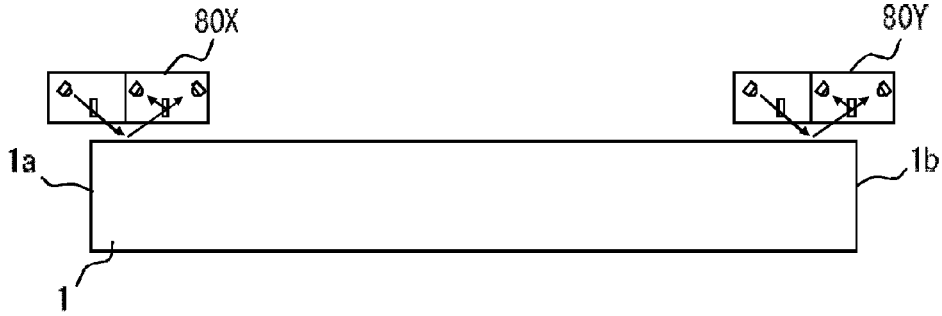

FIGS. 10A and 10B are diagrams illustrating the on-photosensitive-drum registration detecting sensor 80 according to the first embodiment. FIG. 10A is a schematic cross-sectional diagram of the on-photosensitive-drum registration detecting sensor 80. As illustrated in FIG. 10A, light emitted from a light source 80*a* passes through a polarizing plate 80*b* and is reflected from the surface of the photosensitive drum 1. The reflected light is split to scattered light and regular reflection light in a polarizing plate 80*c*, and the amounts of the regular reflection light and the scattered light are respectively measured by measurement devices 80*d* and 80*e*. As the light source 80*a*, for example, an infrared LED having a center wavelength of 850 nm is used. A color registration toner pattern on the photosensitive drum 1 is measured by adding up values obtained by multiplying the regular reflection light amount and the scattered light amount from the photosensitive drum 1 by coefficients. As the coefficients in the embodiment, −0.001 is used for Bk toner and −0.3 is used for color toners of YMC. The output of the on-photosensitive drum registration detecting sensor 80 is set so as to be a value in a range of 0 to 1,023 (0 to 5.115 V in increments of 0.005 V) both in the regular reflection light amount output and the scattered light amount output. Further, the on-photosensitive-drum registration detecting sensor 80 is designed to adjust the LED light amount so that the regular reflection light amount output becomes 500 in the case where toner is not present on the photosensitive drum 1. Further, the on-photosensitive-drum registration detecting sensor 80 also includes a gain adjusting mechanism configured to set the scattered light amount output to be 500 when the regular reflection light amount output is 500.

As illustrated in FIG. 4, the on-photosensitive-drum registration detecting sensor 80 is provided between the developing device 4 and the intermediate transfer belt so as to optically measure the position of a color registration toner pattern in a non-contact manner, the color registration toner pattern being formed on the photosensitive drum 1. FIG. 10B is an arrangement diagram of the on-photosensitive-drum registration detecting sensors 80 (80X, 80Y) with respect to the photosensitive drum 1 of the image forming apparatus 100 according to the first embodiment of the present invention. Two on-photosensitive-drum registration detecting sensors 80 in total are provided in positions, for example, at a distance 40 mm from both ends 1*a* and 1*b* of the photosensitive drum 1, respectively. In this case, the on-photosensitive-drum registration detecting sensor 80 provided at one end 1*a* is referred to as an on-photosensitive-drum registration detecting sensor 80X, and the on-photosensitive-drum registration detecting sensor 80 provided at the other end 1*b* is referred to as an on-photosensitive-drum registration detecting sensor 80Y. Further, the on-photosensitive-drum registration detecting sensors 80X and 80Y are placed in positions, for example, at a distance of about 3 mm from the surface of the photosensitive drum 1.

In the embodiment, one of the two on-photosensitive-drum registration detecting sensors 80 (for example, 80Y) is also used for reading a pattern for laser exposure amount control. The laser exposure amount control will be described later in detail.

As illustrated in FIG. 2, an intermediate transfer unit 9 is provided so as to be opposed to the respective photosensitive drums 1Y, 1M, 1C, and 1Bk of the image forming portions PY, PM, PC, and PBk. As illustrated in FIG. 4, after a toner image is developed on the photosensitive drum 1 at a developing position "c", the toner image is transferred onto the intermediate transfer belt 91 in a primary transfer nip portion (transfer position "d"). At the transfer position "d", the primary transfer roller 92 is placed in contact with the intermediate transfer belt 91 so as to be opposed to the photosensitive drum 1 with the intermediate transfer belt interposed between the primary transfer roller 92 and the photosensitive drum 1. The primary transfer high voltage source 93 as a voltage application unit is connected to the primary transfer roller 92. As the primary transfer roller 92 in the embodiment, for example, a roller formed of conductive sponge is used. Although the resistance of the primary transfer roller 92 is 1 MΩ, an outer diameter thereof is 16 mm, and a longitudinal length thereof is 315 mm, the present invention is not limited by these values.

As illustrated in FIG. 2, a yellow toner image formed on the photosensitive drum 1Y is first transferred onto the intermediate transfer belt 91 by the above-mentioned operation in the image forming portion PY of a first color (yellow). Then, toner images of respective colors (magenta, cyan, and black) formed on the photosensitive drums 1M, 1C, and 1Bk through the similar process are successively multi-transferred onto the intermediate transfer belt 91 in the respective image forming portions PM, PC, and PBk. In the embodiment, the surface potential $V_d$ of the non-exposure portion of the photosensitive drum 1 is −500 V, and as described later, the surface potential $V_L$ of the exposure portion is −100 V. Thus, in order to consider the transfer efficiency with respect to toner transferred onto the exposure portion, a voltage of +500 V is applied to each of primary transfer rollers 92Y, 92M, 92C, and 92Bk as a primary transfer voltage.

As the intermediate transfer belt 91, for example, a resin-based belt, a rubber belt containing a metal core body, or a belt made of both resin and rubber is desired. However, needless to say, an intermediate transfer belt including an elastic layer, considering the enhancement of image quality by preventing scattering and a void of toner, may be used. In the embodiment, a resin belt is used in which a volume resistivity is controlled to about 100 MΩ·cm by dispersing carbon in polyimide. The thickness of the intermediate transfer belt 91 has a thickness of 50 μm, a width of 340 mm, and a whole circumference of 900 mm. However, the present invention is not limited to these values.

Further, the intermediate transfer belt 91 rotates at a speed of 300 mm/sec so as to be matched with the process speed (circumferential velocity) of the photosensitive drum 1.

As illustrated in FIG. 4, after the toner image is transferred at the transfer position "d", the surface of the photosensitive drum 1 is subjected to a residual charge eliminating exposure by a residual charge eliminating exposure device 6. In the embodiment, although the exposure amount for eliminating the residual charge is set to be about 1.0 μJ/cm$^2$, the exposure amount is not limited to this value as long as the residual charge elimination is performed sufficiently.

After that, the toner remaining on the photosensitive drum 1 without being transferred onto the intermediate transfer belt 91 in the transfer position "d" is removed by the cleaning blade 7 provided in contact with the photosensitive drum 1 in a cleaning position "e", and the process proceeds to the subsequent image formation process. As the material for the cleaning blade 7, urethane rubber-based materials are widely used.

Figure 11A:
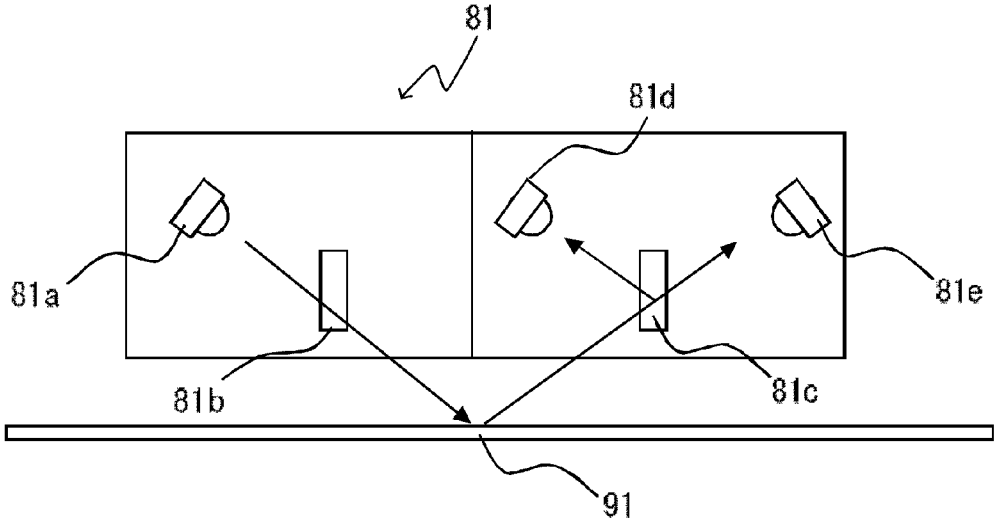
FIGS. 11A and 11B illustrate an on-intermediate-transfer-belt registration detecting sensor 81 according to the first embodiment.
Figure 11B:
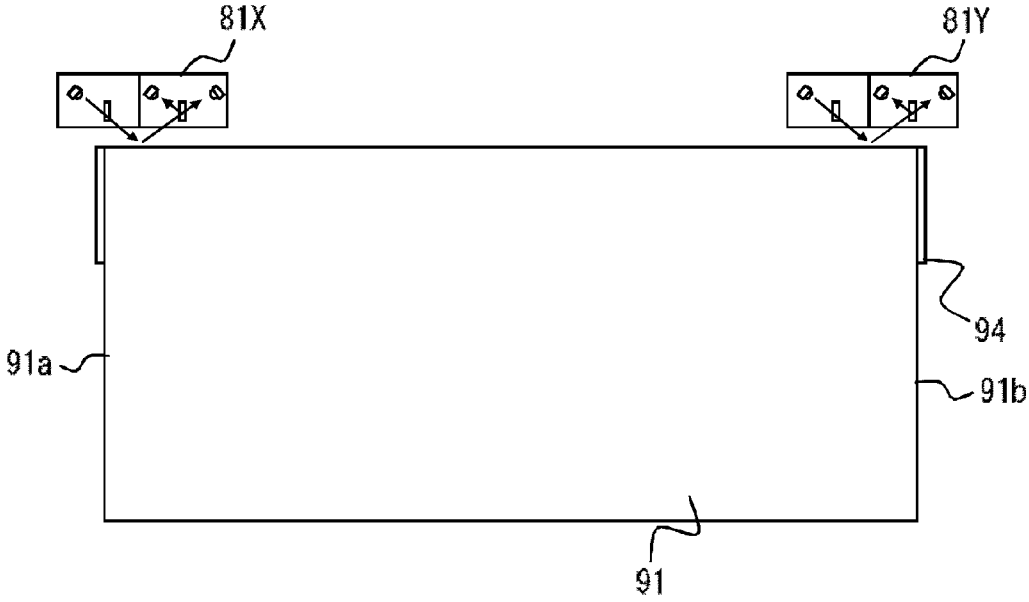

FIGS. 11A and 11B are diagrams illustrating the on-intermediate-transfer-belt registration detecting sensor according to the first embodiment. FIG. 11A is a schematic cross-sectional diagram of the on-intermediate-transfer-belt registration detecting sensor 81. As illustrated in FIG. 11A, light emitted from a light source 81*a* passes through a polarizing plate 81*b* and is reflected from the surface of the intermediate transfer belt 91. The reflected light is split to scattered light and regular reflection light in a polarizing plate 81*c*, and the amounts of the regular reflection light and the scattered light are respectively measured by measurement devices 81*d* and 81*e*. As the light source 81*a*, for example, an infrared LED having a center wavelength of 850 nm is used. A color registration toner pattern on the intermediate transfer belt 91 is measured by adding up values obtained by multiplying the regular reflection light amount and the scattered light amount from the intermediate transfer belt 91 by coefficients. As the coefficients in the embodiment, −0.001 is used for Bk toner and −0.3 is used for color toners of YMC. The output of the on-intermediate-transfer-belt registration detecting sensor 81 is set so as to be a value in a range of 0 to 1,023 (0 to 5.115 V in increments of 0.005 V) both in the regular reflection light amount output and the scattered light amount output. Further, the on-intermediate-transfer-belt registration detecting sensor 81 is designed to adjust the LED light amount so that the regular reflection light amount output becomes 500 in the case where toner is not present on intermediate transfer belt 91. Further, the on-intermediate-transfer-belt registration detecting sensor 81 also includes a gain adjusting mechanism configured to set the scattered light amount output to be 500 when the regular reflection light amount output is 500.

As illustrated in FIG. 2, the on-intermediate-transfer-belt registration detecting sensor 81 optically measures the position of a color registration toner pattern in a non-contact manner at the position of the intermediate transfer belt driven roller 94, the color registration toner pattern being formed on the intermediate transfer belt 91. FIG. 11B is an arrangement diagram of the on-intermediate-transfer-belt registration detecting sensor 81 (81X, 81Y) with respect to the intermediate transfer belt of the image forming apparatus 100 according to the first embodiment. Two on-intermediate-transfer-belt registration detecting sensors 81 in total are provided in positions, for example, at a distance of 30 mm from both widthwise ends 91*a* and 91*b* of the intermediate transfer belt 91, respectively, at the position of the intermediate transfer belt driven roller 94. In this case, the on-intermediate-transfer-belt registration detecting sensor 81 provided at one end 91*a* is referred to as an on-intermediate-transfer-belt registration detecting sensor 81X, and the on-intermediate-transfer-belt registration detecting sensor 81 provided at the other end 91*b* is referred to as an on-intermediate-transfer-belt registration detecting sensor 81Y. Further, the on-intermediate-transfer-belt registration detecting sensors 81X and 81Y are placed in positions, for example, at a distance of about 3 mm from the surface of the intermediate transfer belt 91.

As illustrated in FIG. 2, the toner images of four colors formed on the intermediate transfer belt 91 are collectively transferred to the transfer material S by the secondary transfer roller 10. The transfer material S is supplied from a transfer material containing unit (not shown) and fed by a sheet feed roller 13 as a feeding unit at predetermined timing. In the embodiment, in order to consider the transfer efficiency of toner from the intermediate transfer belt 91 to the transfer material S, a voltage of +1,500 V is applied to the secondary transfer outer roller 96 as a secondary transfer voltage.

The transfer material S on which the toner images have been transferred is conveyed to a roller fixing unit 12 as a fixing device, and heat and pressure are applied to the transfer material S so that the toner images are fused and fixed to the transfer material S. After that, the transfer material S is delivered out of the apparatus to obtain a color print image.

The secondary transfer residual toner remaining on the intermediate transfer belt 91 without being transferred onto the transfer material S is removed by the cleaning blade 11*a* as a cleaning unit provided in an intermediate transfer belt cleaner 11 provided in contact with the intermediate transfer belt 91, and the process proceeds to the subsequent image formation process. As the material for the cleaning blade 11*a*, urethane rubber-based materials are widely used.

Color Registration

Next, color registration using the on-photosensitive-drum registration detecting sensor 80 and the on-intermediate-transfer-belt registration detecting sensor 81 will be described in detail.

The color registration in the first embodiment is to adjust the position of a color toner image transferred onto the intermediate transfer belt 91. For this purpose, a color registration toner pattern on the photosensitive drum 1 and a color registration toner pattern on the intermediate transfer belt 91 are measured with the on-photosensitive-drum registration detecting sensor 80 and the on-intermediate-transfer-belt registration detecting sensor 81, respectively, and a difference in the respective color misregistrations is calculated. The color registration includes downtime color registration and color registration in image formation. The downtime color registration is the control configured to perform color registration by providing downtime for each of time of turning on a power source of the image forming apparatus 100 and time of performing image formation on predetermined number of transfer materials S. On the other hand, the color registration in image formation is the control configured to perform color registration immediately before image formation. However, in the color registration in image formation, when the color registration toner pattern on the intermediate transfer belt 91 is actually measured by the on-intermediate-transfer-belt registration detecting sensor 81, a time period required for image formation is prolonged by the measurement time. Therefore, in the color registration in image formation of the embodiment, a value obtained in the downtime color registration is used as it is for the color registration on the intermediate transfer belt 91.

The color registration to be performed actually will be hereinafter described by way of examples.

First, the downtime color registration will be described.

Figure 12:
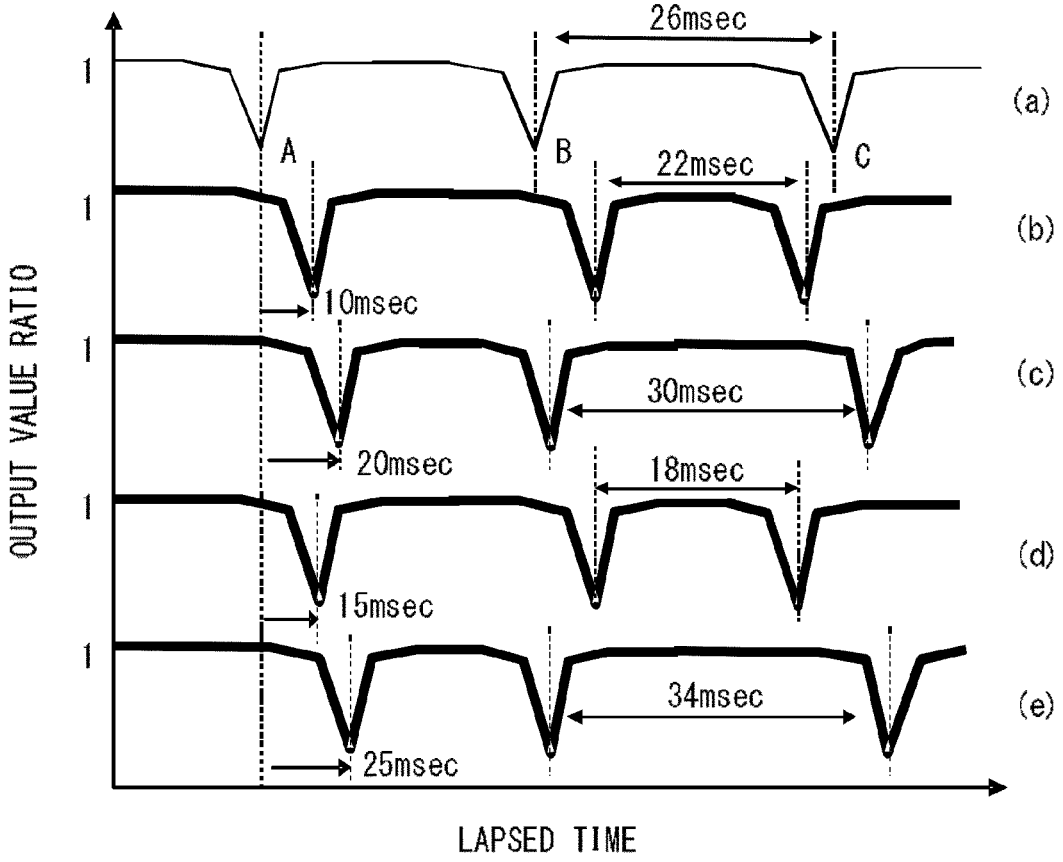
FIG. 12 is a graph showing a change in an output value ratio of on-photosensitive-drum registration detecting sensors 80X, 80Y and on-intermediate-transfer-belt registration detecting sensors 81X, 81Y according to the first embodiment, with respect to lapsed time.

The CPU 103 detects timing at which a main scanning direction color registration toner pattern comes to a position of each sensor after a sub scanning direction color registration toner pattern comes to the position, from a change in an output value ratio of the on-photosensitive-drum registration detecting sensor 80 and the on-intermediate-transfer-belt registration detecting sensor 81. FIG. 12 illustrates a change in an output value ratio of each sensor with respect to lapsed time. The lapsed time refers to lapsed time from ideal timing at which each sensor detects a sub scanning direction color registration toner pattern. In FIG. 12, (a) shows a change in an output value ratio of each sensor with respect to lapsed time in an ideal pattern; (b) shows a change in an output value ratio actually observed by the on-photosensitive-drum registration detecting sensor 80X provided at the one end 1*a* of the photosensitive drum 1 with respect to lapsed time; (c) shows a change in an output value ratio actually observed by the on-photosensitive-drum registration detecting sensor 80Y provided at the other end 1*b* of the photosensitive drum 1 with respect to lapsed time; (d) shows a change in an output value ratio actually observed by the on-intermediate-transfer-belt registration detecting sensor 81X provided at the one end 91*a* in a width direction of the intermediate transfer belt 91 with respect to lapsed time, at the position of the intermediate transfer belt driven roller 94; and (e) shows a change in an output value ratio actually observed by the on-intermediate-transfer-belt registration detecting sensor 81Y provided at the other end 91*b* in the width direction of the intermediate transfer belt 91 with respect to lapsed time, at the position of the intermediate transfer belt drive roller 94. It is assumed that the on-photosensitive-drum registration detecting sensor 80X and the on-intermediate-transfer-belt registration detecting sensor 81X are placed at ends on the same side in the image forming apparatus 100. Similarly, it is assumed that the on-photosensitive-drum registration detecting sensor 80Y and the on-intermediate-transfer-belt registration detecting sensor 81Y are placed at ends on the same side in the image forming apparatus 100.

First, timing at which a rapid change (peak A) in an output value ratio of each sensor is detected with respect to a sub scanning direction color registration toner pattern is considered. The ideal timing is time obtained by dividing a rotation distance of the photosensitive drum 1 from the exposure position "b" to the position of the on-photosensitive-drum registration detecting sensor 80 by a process speed, that is, in the case of the embodiment, the ideal timing is represented by an expression: 29.71 mm÷300 mm/sec≈99 msec. Specifically, the ideal lapsed time from a time when a sub scanning direction color registration toner pattern is formed on the photosensitive drum 1 in the exposure position "b" to a time when the sub scanning direction color registration toner pattern is detected by the on-photosensitive-drum registration detecting sensor 80 is 99 msec. Therefore, the ideal timing at which the on-photosensitive-drum registration detecting sensor 80 detects a sub scanning direction color registration toner pattern is timing at which 99 msec have lapsed from a time when the sub scanning direction color registration toner pattern is formed on the photosensitive drum 1 in the exposure position "b".

Further, the distance from the exposure position "b" to the on-intermediate-transfer-belt registration detecting sensor 81 is 385.18 mm in the case of the process cartridge 8Y. Thus, the ideal timing at which the on-intermediate-transfer-belt registration detecting sensor 81 detects the sub scanning direction color registration toner pattern formed by the process cartridge 8Y is represented by an expression: 385.18 mm÷300 mm/sec≈1,284 msec. Specifically, the ideal lapsed time from a time when a sub scanning direction color registration toner pattern is formed on the photosensitive drum 1Y in the exposure position "b" to a time when the sub scanning direction color registration toner pattern is detected by the on-intermediate-transfer-belt registration detecting sensor 81 is 1,284 msec. Thus, the ideal timing at which the on-intermediate-transfer-belt registration detecting sensor 81 detects the sub scanning direction color registration toner pattern of yellow is timing at which 1,284 msec have lapsed from a time when the sub scanning direction color registration toner pattern is formed on the photosensitive drum 1Y in the exposure position "b".

The process cartridges 8Y, 8M, 8C, and 8Bk are placed at an interval of 102 mm, and hence, the ideal timing for the process cartridges 8Y, 8M, 8C, and 8Bk decreases in increments of 102 mm÷300 mm/sec≈340 msec in this order. The ideal timing at which the on-intermediate-transfer-belt registration detecting sensor 81 detects a sub scanning direction color registration toner pattern of magenta is timing at which 944 msec have lapsed from a time when the sub scanning direction color registration toner pattern is formed on the photosensitive drum 1M in the exposure position "b". The ideal timing at which the on-intermediate-transfer-belt registration detecting sensor 81 detects a sub scanning direction color registration toner pattern of cyan is timing at which 604 msec have lapsed from a time when the sub scanning direction color registration toner pattern is formed on the photosensitive drum 1C in the exposure position "b". The ideal timing at which the on-intermediate-transfer-belt registration detecting sensor 81 detects a sub scanning direction color registration toner pattern of black is timing at which 264 msec have lapsed from a time when the sub scanning direction color registration toner pattern is formed on the photosensitive drum 1Bk in the exposure position "b". Note that, the color registration toner patterns of Y, M, C, and Bk are formed at shifted timing so that the color registration toner patterns of the four colors are not superimposed on each other on the intermediate transfer belt 91.

Thus, the CPU 103 can estimate color misregistration in a sub scanning direction in each sensor from a shift of timing, at which an actual change in an output value ratio of each sensor is detected, from the ideal timing.

In this case, it is assumed that a change in an output value ratio of the on-photosensitive-drum registration detecting sensor 80X with respect to the sub scanning direction color registration toner pattern is observed 10 msec after the ideal timing, as shown by (b) in FIG. 12. Further, it is assumed that a change in an output value ratio of the on-photosensitive-drum registration detecting sensor 80Y with respect to the sub scanning direction color registration toner pattern is observed 20 msec after the ideal timing, as shown by (c) of FIG. 12. Similarly, it is assumed that a change in an output value ratio of the on-intermediate-transfer-belt registration detecting sensor 81X with respect to the sub scanning direction color registration toner pattern is observed 15 msec after the ideal timing, as shown by (d) of FIG. 12. Further, it is assumed that a change in an output value ratio of the on-intermediate-transfer-belt registration detecting sensor 81Y with respect to the sub scanning direction color registration toner pattern is observed 25 msec after the ideal timing, as shown by (e) of FIG. 12. In this case, the CPU 103 corrects output timing of a laser beam of the exposure device 3 of Y, M, C, and Bk so that an image signal is output 15 msec earlier at the end where the on-photosensitive-drum registration detecting sensor 80X and the on-intermediate-transfer-belt registration detecting sensor 81X are provided, and an image signal is output 25 msec earlier at the end where the on-photosensitive-drum registration detecting sensor 80Y and the on-intermediate-transfer-belt registration detecting sensor 81Y are provided. It is assumed that the correction in a position in a longitudinal direction between both the ends is linear interpolation. Further, the CPU 103 determines that there is a shift of 5 msec in a sub scanning direction at both ends between the on-photosensitive-drum registration detecting sensor 80 and the on-intermediate-transfer-belt registration detecting sensor 81.

Next, the CPU 103 measures timing (lapsed time) at which two peaks (B and C) each showing a rapid change in an output value ratio of a sub scanning direction color registration toner pattern are detected. Then, the CPU 103 estimates an interval of the timing at which the two peaks B and C are respectively detected. Ideally, in the case where the on-photosensitive-drum registration detecting sensor 80 passes through the center of a dogleg (MB in FIG. 17B), the interval of the timing becomes time (26 msec) obtained by dividing the interval (7.81 mm) of the center of the dogleg by a process speed (300 mm/sec).

As shown by (a) of FIG. 12, a peak interval at the ideal timing is 26 msec. In contrast, it is assumed that a peak interval observed in the on-photosensitive-drum registration detecting sensor 80X is 22 msec, and further, a peak interval observed in the on-photosensitive-drum registration detecting sensor 80Y is 30 msec. Specifically, it is assumed that the peak interval observed in the on-photosensitive-drum registration detecting sensor 80X is smaller by 4 msec with respect to the ideal peak interval of 26 msec, and the peak interval observed in the on-photosensitive-drum registration detecting sensor 80Y is larger by 4 msec with respect to the ideal peak interval of 26 msec. Similarly, it is assumed that a peak interval observed in the on-intermediate-transfer-belt registration detecting sensor 81X is 18 msec, and a peak interval observed in the on-intermediate-transfer-belt registration detecting sensor 81Y is 34 msec. Specifically, it is assumed that the peak interval observed in the on-intermediate-transfer-belt registration detecting sensor 81X is smaller by 8 msec with respect to the ideal peak interval of 26 msec, and the peak interval observed in the on-intermediate-transfer-belt registration detecting sensor 81Y is larger by 8 msec with respect to the ideal peak interval of 26 msec. In this case, the CPU 103 forms an image signal in which image exposure is shifted by 8 msec to the end at which the on-photosensitive-drum registration detecting sensor 80X and the on-intermediate-transfer-belt registration detecting sensor 81X are provided. It is assumed that the correction in a position in a longitudinal direction between both the ends is linear interpolation. Further, the CPU 103 determines that there is a shift of 4 msec in a main scanning direction at both ends between the on-photosensitive-drum registration detecting sensor 80 and the on-intermediate-transfer-belt registration detecting sensor 81.

Next, color registration in image formation will be described.

Figure 13:
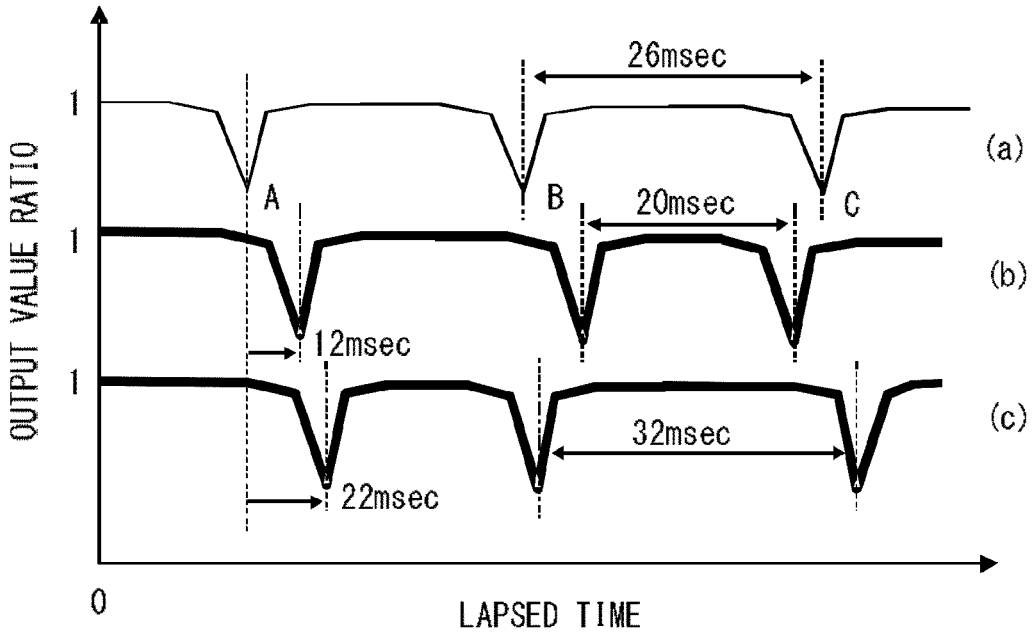
FIG. 13 is a graph showing a change in an output value ratio of the on-photosensitive-drum registration detecting sensors 80X and 80Y according to the first embodiment, with respect to lapsed time.

The CPU 103 detects timing at which a main scanning direction color registration toner pattern comes to a position of the on-photosensitive-drum registration detecting sensor 80 after a sub scanning direction color registration toner pattern comes to the position, from a change in an output value ratio of the on-photosensitive-drum registration detecting sensor 80. FIG. 13 shows a change in an output value ratio of the on-photosensitive-drum registration detecting sensors 80X and 80Y with respect to lapsed time. In FIG. 13, (a) shows a change in an output value ratio of the on-photosensitive-drum registration detecting sensor 80X or 80Y at the ideal timing with respect to lapsed time; (b) shows a change in an output value ratio actually observed by the on-photosensitive-drum registration detecting sensor 80X with respect to lapsed time; and (c) shows a change in an output value ratio actually observed by the on-photosensitive-drum registration detecting sensor 80Y with respect to lapsed time.

The ideal timing at which a rapid change (peak A) of an output value ratio of the on-photosensitive-drum registration detecting sensor 80X or 80Y is detected with respect to the sub scanning direction color registration toner pattern is 99 msec in the embodiment, as described above. In this case, it is assumed that a change in an output value ratio of the on-photosensitive-drum registration detecting sensor 80X with respect to the sub scanning direction color registration toner pattern is observed 12 msec after the ideal timing, as shown by (b) of FIG. 13. Further, it is assumed that a change in an output value ratio of the on-photosensitive-drum registration detecting sensor 80Y with respect to the sub scanning direction color registration toner pattern is observed 22 msec after the ideal timing, as shown by (c) of FIG. 13. In the above-mentioned downtime color registration, it is estimated that there is a shift of 5 msec in the sub scanning direction at both the ends between the on-photosensitive-drum registration detecting sensor 80 and the on-intermediate-transfer-belt registration detecting sensor 81. Thus, in the color registration in image formation of the embodiment, the CPU 103 performs correction so that an image signal is output 17 msec earlier at the end where the on-photosensitive-drum registration detecting sensor 80X is provided, and an image signal is output 27 msec earlier at the end where the on-photosensitive-drum registration detecting sensor 80Y is provided. It is assumed that the correction in a position in a longitudinal direction between both the ends is linear interpolation.

Next, the CPU 103 measures timing (lapsed time) at which two peaks (B and C) each showing a rapid change in an output value ratio of a sub scanning direction color registration toner pattern are detected. Then, the CPU 103 estimates an interval of the timing at which the two peaks B and C are respectively detected. Ideally, in the case where the on-photosensitive-drum registration detecting sensor 80 passes through the center of a dogleg (MB in FIG. 17B), the interval of the timing becomes time (26 msec) obtained by dividing the interval (7.81 mm) of the center of the dogleg by the process speed (300 mm/sec).

As shown by (a) of FIG. 13, a peak interval at the ideal timing is 26 msec. In contrast, it is assumed that a peak interval observed in the on-photosensitive-drum registration detecting sensor 80X is 20 msec, and further, a peak interval observed in the on-photosensitive-drum registration detecting sensor 80Y is 32 msec. Specifically, it is assumed that the peak interval observed in the on-photosensitive-drum registration detecting sensor 80X is smaller by 6 msec with respect to the ideal peak interval of 26 msec, and the peak interval observed in the on-photosensitive-drum registration detecting sensor 80Y is larger by 6 msec with respect to the ideal peak interval of msec. In the above-mentioned downtime color registration, it is estimated that there is a shift of 4 msec in the main scanning direction at both the ends between the on-photosensitive-drum registration detecting sensor 80 and the on-intermediate-transfer-belt registration detecting sensor 81. Thus, in the color registration in image formation of the embodiment, the CPU 103 forms an image signal in which image exposure is shifted by 10 msec to the end at which the on-photosensitive-drum registration detecting sensor 80X is provided. It is assumed that the correction in a position in a longitudinal direction between both the ends is linear interpolation.

As described above, in the color registration in image formation, when the on-photosensitive-drum registration detecting sensor 80 reads a color registration toner pattern on the photosensitive drum 1, color misregistration on the intermediate transfer belt 91 can be corrected.

Downtime Color Registration Sequence

Downtime color registration sequence will be hereinafter described. In the downtime color registration sequence, color registration is performed by providing downtime for each of time of turning on a power source of the image forming apparatus 100 and time of performing image formation on predetermined number of transfer materials S in the first embodiment of the present invention. In the embodiment, downtime is provided for each of the time of turning on the power source of the image forming apparatus 100 and the time of performing image formation on the predetermined number of transfer materials S, and the CPU 103 performs the following sequence. Note that, "performing image formation on predetermined number of transfer materials S" in the embodiment refers to the case where image formation is performed on 5,000 sheets in terms of an A4 paper size.

Figure 14:
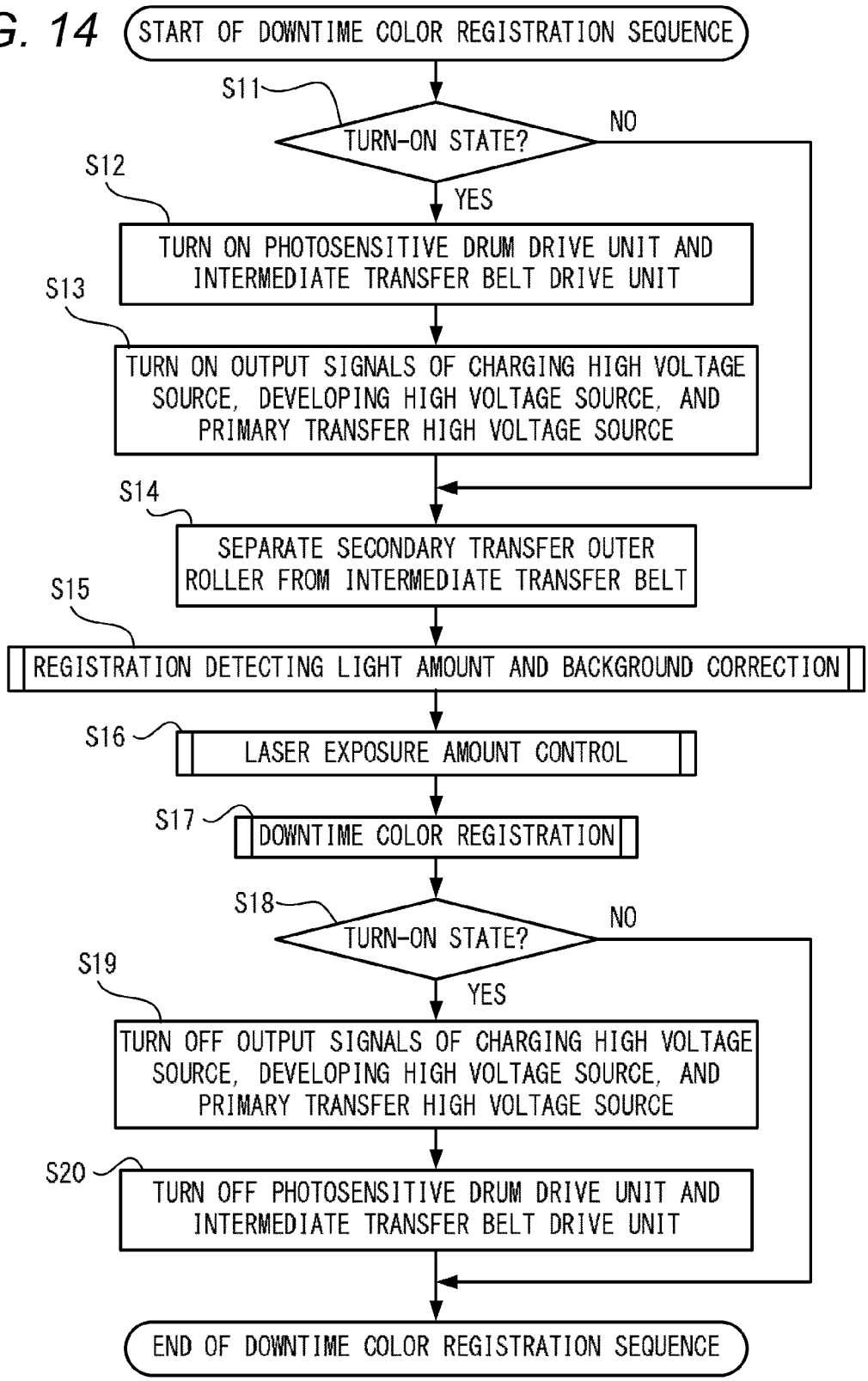
FIG. 14 is a flowchart of a downtime color registration sequence performed in the image forming apparatus 100 according to the first embodiment.

FIG. 14 is a flowchart of the downtime color registration sequence to be performed in the image forming apparatus 100 according to the first embodiment of the present invention. First, it is checked whether or not downtime color registration is the control to be performed when the power source of the image forming apparatus 100 is turned on (S11). In the case where the downtime color registration is the control to be performed when the power source is turned on (YES in S11), the CPU 103 turns on the photosensitive drum drive unit 19 and the intermediate transfer belt drive unit 20 (S12). After that, the CPU 103 turns on output signals of the charging high voltage source 101, the developing high voltage source 106, and the primary transfer high voltage source 93 (S13), and the process proceeds to Step S14. On the other hand, in the case where the downtime color registration is not the control to be performed when the power source is turned on but the control to be performed when image formation is performed on the predetermined number of transfer materials S (NO in S11), Steps S12 and S13 are omitted because these steps have already been performed, and the process proceeds to Step S14.

Next, the secondary transfer outer roller 96 is separated from the intermediate transfer belt 91 by using the secondary transfer outer roller contact-separation mechanism 96*a* so that a color registration toner pattern on the intermediate transfer belt 91 and a registration detecting light amount correction pattern do not contaminate the secondary transfer outer roller 96 (S14). Then, registration detecting light amount and background correction is performed (S15).

Figure 15:
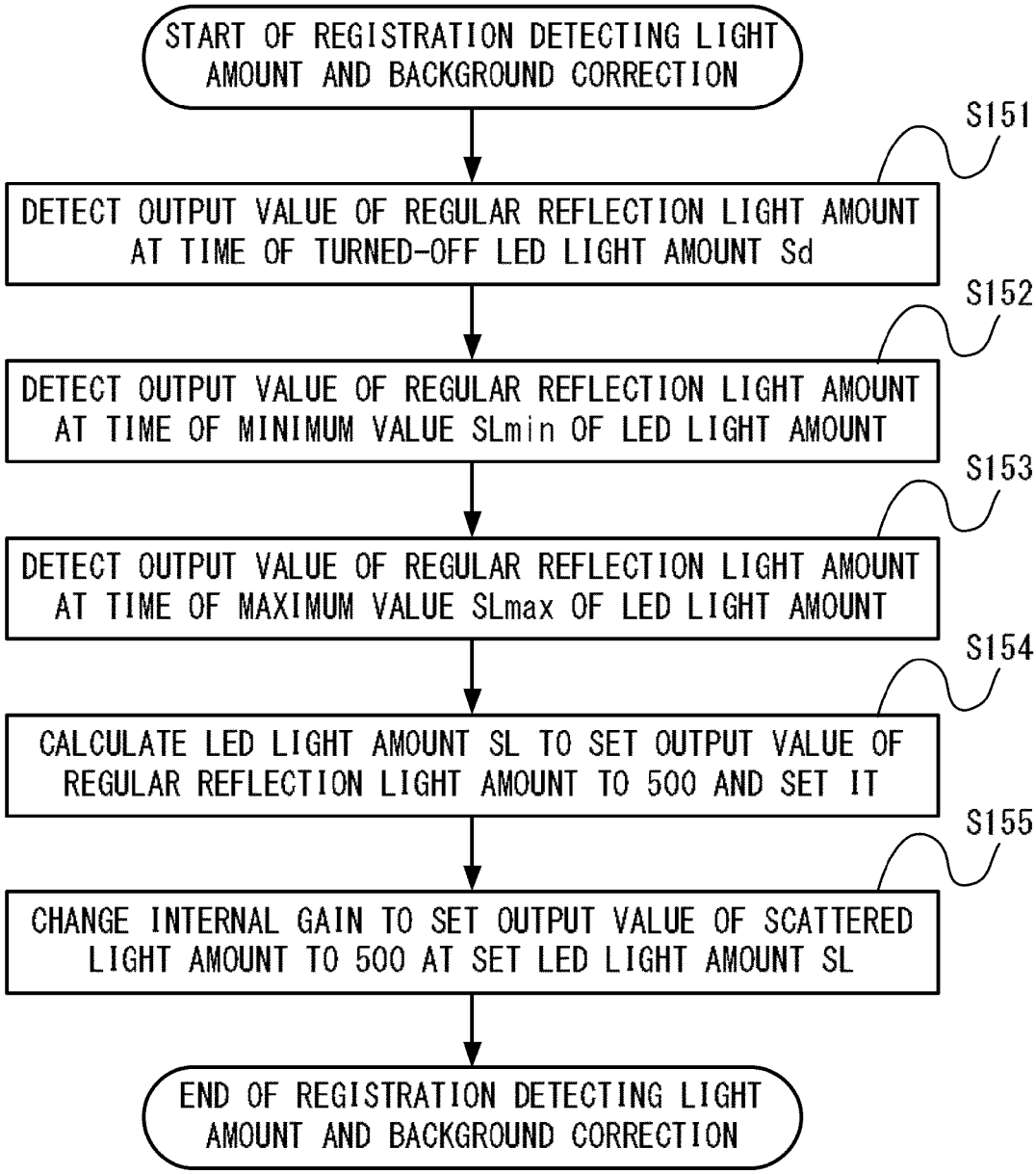
FIG. 15 is a flowchart of registration detecting light amount and background correction performed in the image forming apparatus 100 according to the first embodiment.

FIG. 15 is a flowchart of the registration detecting light amount and background correction. First, the measurement device 80*e* detects and measures an output value of a regular reflection light amount when the LED light source 80*a* of the on-photosensitive-drum registration detecting sensor 80 is turned off (dark portion), i.e., at a time of a turned-off LED light amount Sd (S151). Next, the measurement device 80*e* detects and measures an output value of a regular reflection light amount when an output (LED light amount) of the LED light source 80*a* of the on-photosensitive-drum registration detecting sensor 80 is a minimum value $SL_{min}$ (S152). Then, the measurement device 80*e* detects and measures an output value of a regular reflection light amount when an output of the LED light source 80*a* of the on-photosensitive-drum registration detecting sensor 80 is a maximum value $SL_{max}$ (S153). Then, the CPU 103 calculates an output value SL of the LED light source 80*a* to set an output value of a regular reflection light amount to 500 and sets that value in the on-photosensitive-drum registration detecting sensor 80 (S154). Then, the CPU 103 changes an internal gain to set an output value of a scattered light amount to 500 when the output of the LED light source 80*a* of the on-photosensitive-drum registration detecting sensor 80 is the set output value SL (S155). Similarly, in the on-intermediate-transfer-belt registration detecting sensor 81, the CPU 103 sets an output value SL of the LED light source 81*a* to set an output value of a regular reflection light amount to 500 and changes an internal gain to set an output value of a scattered light amount to 500 when the LED light amount is the set output value SL. Accordingly, the registration detecting light amount and background correction is ended.

Next, laser exposure amount control is performed (S16). In the embodiment, a laser exposure amount in usual image formation is set so that, when the surface potential $V_d$ of the non-exposure portion of the photosensitive drum 1 is −500 V, the surface potential $V_L$ of the exposure portion of the photosensitive drum 1 becomes −100 V. For this purpose, the CPU 103 performs the following laser exposure amount control sequence.

Figure 16:
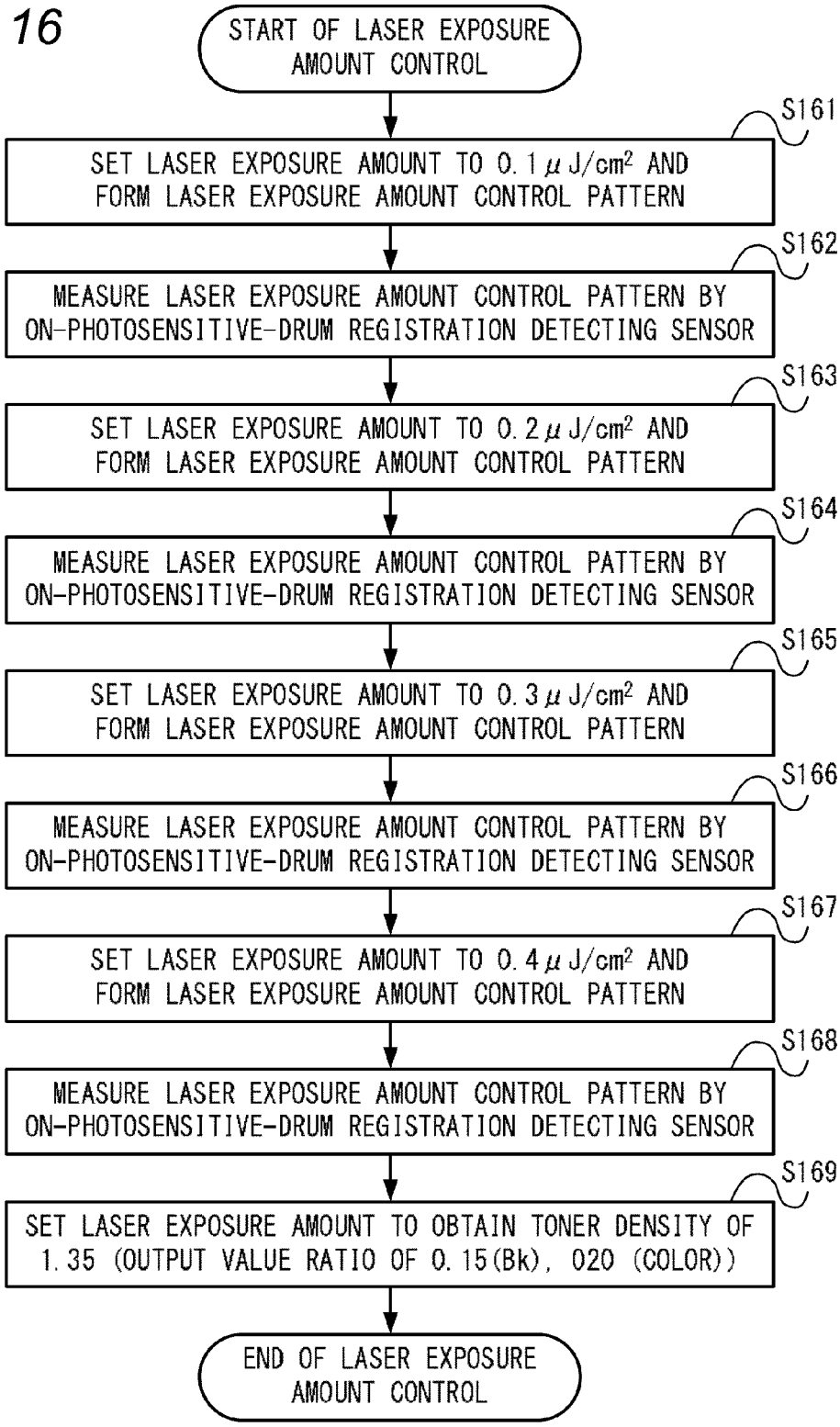
FIG. 16 is a flowchart of laser exposure amount control performed in the image forming apparatus 100 according to the first embodiment.

FIG. 16 is a flowchart of laser exposure amount control. First, the exposure device 3 is set so that a laser exposure amount becomes 0.1 μJ/cm$^2$, and a laser exposure amount control toner pattern is formed on the surface of the photosensitive drum 1 (S161). Then, the formed laser exposure amount control toner pattern is measured by the on-photosensitive-drum registration detecting sensor 80 (S162). Next, the formed pattern is removed by the cleaning blade 7, the exposure device 3 is set so that a laser exposure amount newly becomes 0.2 μJ/cm$^2$, and a laser exposure amount control toner pattern is formed on the surface of the photosensitive drum 1 (S163). Then, the formed laser exposure amount control toner pattern is measured by the on-photosensitive-drum registration detecting sensor 80 (S164). Then, the formed pattern is removed by the cleaning blade 7, the exposure device 3 is set so that a laser exposure amount newly becomes 0.3 μJ/cm$^2$, and a laser exposure amount control toner pattern is formed on the surface of the photosensitive drum 1 (S165). Then, the formed laser exposure amount control toner pattern is measured by the on-photosensitive-drum registration detecting sensor 80 (S166). Then, the formed pattern is removed by the cleaning blade 7, the exposure device 3 is set so that a laser exposure amount newly becomes 0.4 μJ/cm$^2$, and a laser exposure amount control toner pattern is formed on the surface of the photosensitive drum 1 (S167). Then, the formed laser exposure amount control toner pattern is measured by the on-photosensitive-drum registration detecting sensor 80 (S168).

Figure 17A:
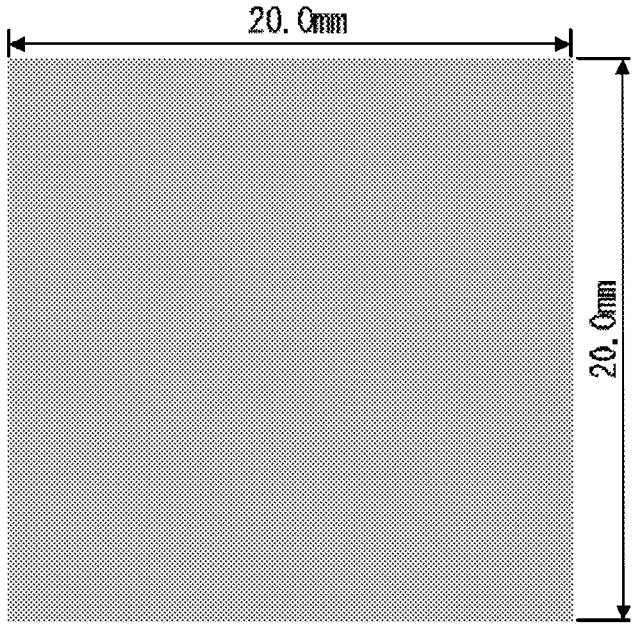
FIGS. 17A and 17B are diagrams illustrating a toner pattern used in the image forming apparatus 100 according to the first embodiment.
Figure 17B:
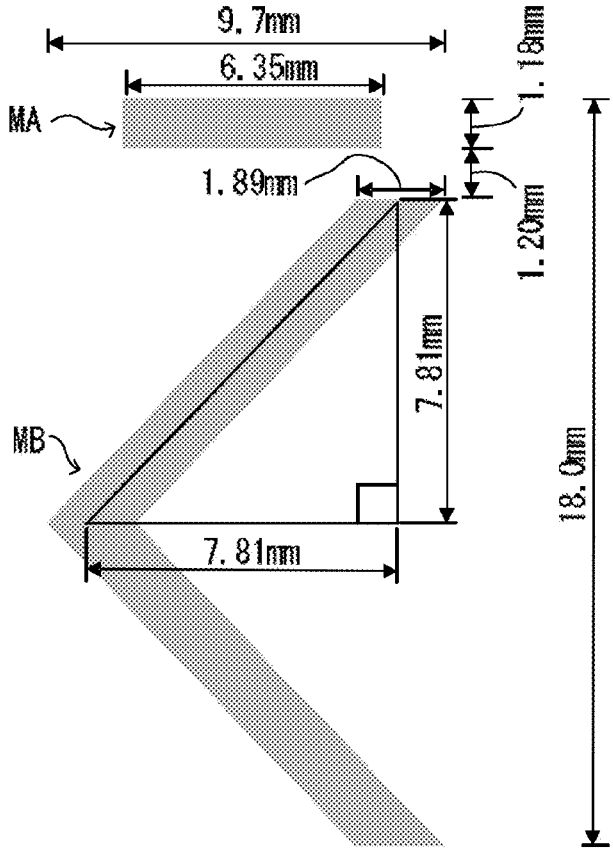

FIGS. 17A and 17B are diagrams illustrating a toner pattern to be used in the image forming apparatus 100 according to the first embodiment. FIG. 17A is a diagram illustrating a toner pattern to be used in the laser exposure amount control. In the embodiment, as the laser exposure amount control toner pattern, a square pattern having a size of 20.0 mm square illustrated in FIG. 17A is used. Note that, the laser exposure amount control toner pattern is formed in a position at a distance of 40 mm from the other end 1*b* in a longitudinal direction of the photosensitive drum 1 so as to be matched with the position of one of the two on-photosensitive-drum registration detecting sensors (80Y).

Then, the CPU 103 sets a laser exposure amount to obtain a toner density of 1.35 (output value ratio: 0.15 (Bk), 0.20 (Y, M, and C)) (S169). In the embodiment, as shown in FIG. 5, when the surface potential $V_d$ is −500 V, the surface potential $V_L$ is −200 V at a laser exposure amount of 0.1 μJ/cm$^2$, and the surface potential $V_L$ is −100 V at a laser exposure amount of 0.2 μJ/cm$^2$. Further, the surface potential $V_L$ is −50 V at a laser exposure amount of 0.3 μJ/cm$^2$, and the surface potential $V_L$ is −25 V at a laser exposure amount of 0.4 μJ/cm$^2$. As shown in FIG. 9A, in order to set a toner density to be 1.35, the contrast potential $V_{cont}$ may be set to be 200 V. Thus, the DC voltage $V_{dev}$ of a developing bias voltage of the embodiment is set to be −300 V, and hence, in order to set the contrast potential $V_{cont}$ to be 200 V, the surface potential $V_L$ may be set to be −100 V in usual image formation, from a relationship: $V_L - V_{dev} = V_{cont}$. For this purpose, the laser exposure amount in usual image formation in the embodiment is set to be 0.2 μJ/cm$^2$. Accordingly, the laser exposure amount control is ended.

Next, downtime color registration is performed (S17).

Figure 18:
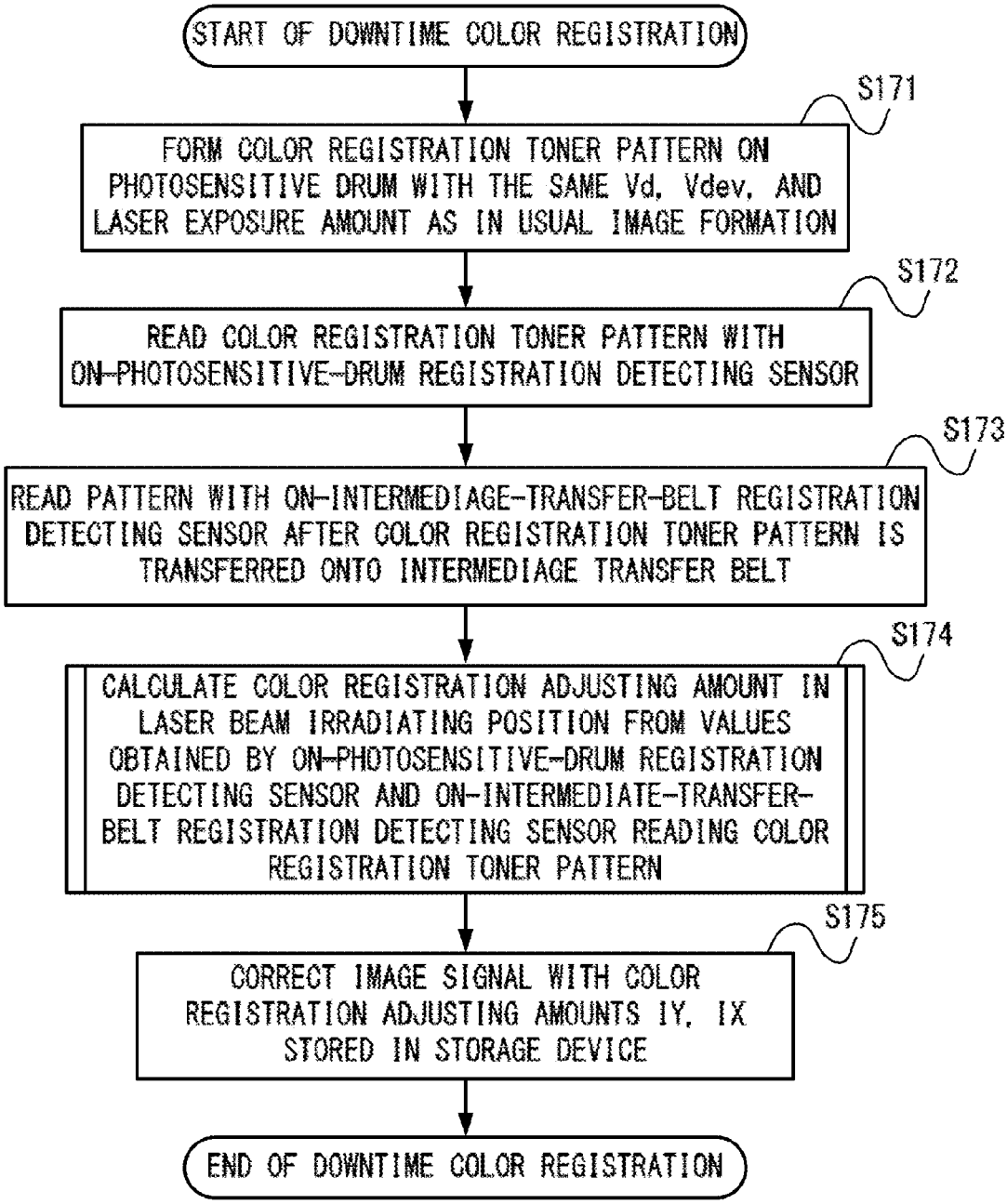
FIG. 18 is a flowchart of downtime color registration performed in the image forming apparatus 100 according to the first embodiment.

FIG. 18 is a flowchart of the downtime color registration in the embodiment. First, a color registration toner pattern is formed on the photosensitive drum 1 with the same surface potential $V_d$, DC voltage $V_{dev}$, and laser exposure amount (that is, −500 V, −300 V, and 0.2 μJ/cm$^2$) as those in usual image formation (S171). Then, the on-photosensitive-drum registration detecting sensor 80 reads the formed color registration toner pattern (S172). After the formed pattern is transferred onto the intermediate transfer belt 91, the on-intermediate-transfer-belt registration detecting sensor 81 reads the transferred pattern (S173).

In the embodiment, as the color registration toner pattern, a pattern having a width of 9.7 mm and a length of 18.0 mm illustrated in FIG. 17B is used. The color registration toner pattern includes a sub scanning direction color registration toner pattern MA having a width of 6.35 mm and a line thickness of 1.18 mm and a main scanning direction color registration toner pattern MB having a shape of a dogleg and a width of 7.81 mm, a height of 15.62 mm, and a line thickness of 1.89 mm. The respective color registration toner patterns are formed in positions at a distance of 40 mm from both ends of the photosensitive drum 1 so as to be matched with the positions of the two on-photosensitive-drum registration detecting sensors 80X and 80Y. Then, the respective color registration toner patterns are transferred to positions at a distance of 30 mm from both widthwise ends of the intermediate transfer belt 91 so as to be matched with the positions of the two on-intermediate-transfer-belt registration detecting sensors 81X and 81Y. In order to prevent the sub scanning direction color registration toner patterns MA of the respective colors formed in the image forming portions PY, PM, PC, and PBk from being superimposed on each other, the sub scanning direction color registration toner patterns MA are respectively shifted by 20 mm in the embodiment.

The CPU 103 calculates a color registration adjusting amount in a laser beam irradiating position from values obtained by the on-photosensitive-drum registration detecting sensor 80 and the on-intermediate-transfer-belt registration detecting sensor 81 which read the color registration toner patterns (S174).

The calculation of the color registration adjusting amount in the laser beam irradiating position is hereinafter described in detail.

Figure 19:
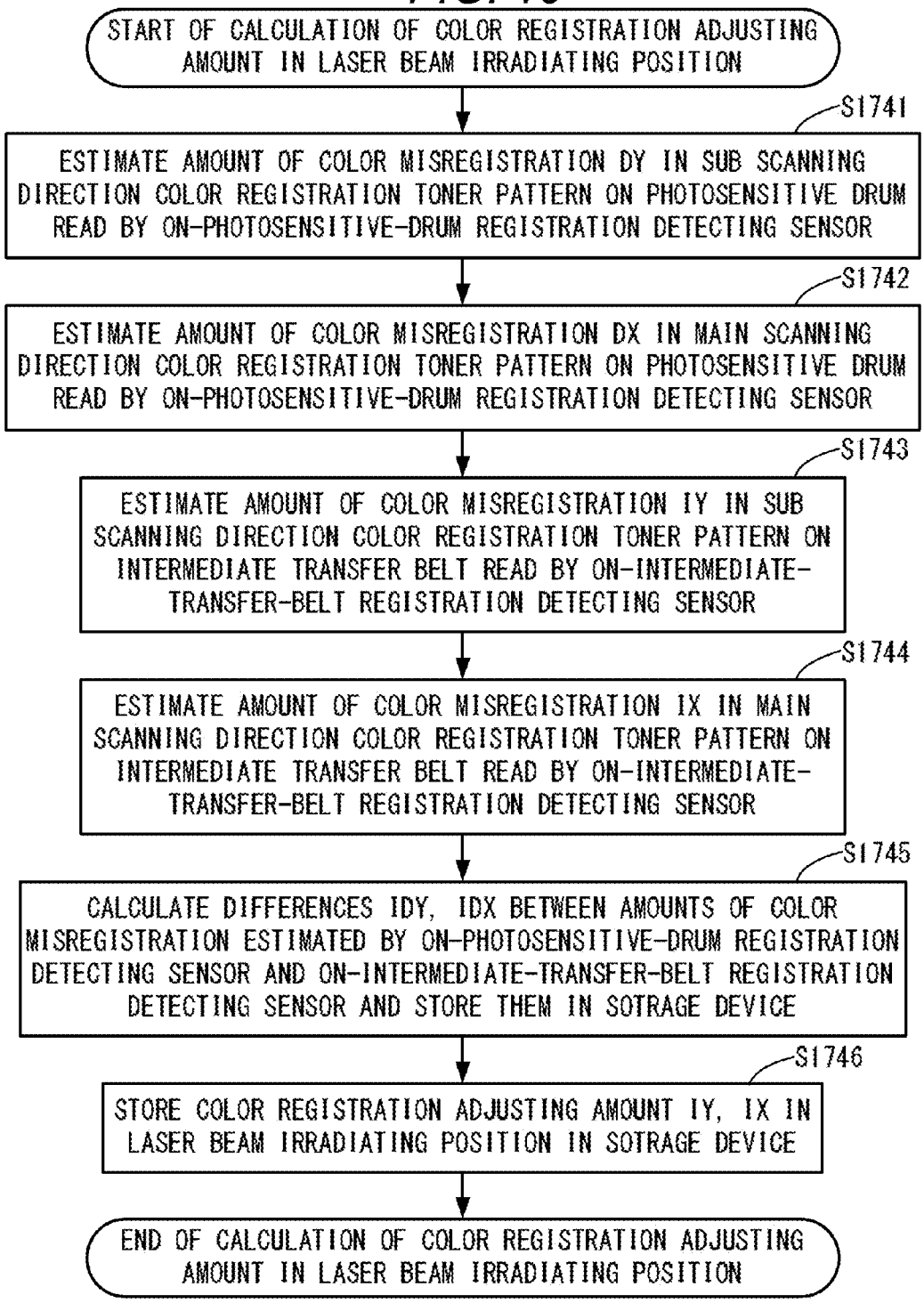
FIG. 19 is a flowchart of calculation of a color registration adjusting amount performed in the image forming apparatus 100 according to the first embodiment.

FIG. 19 is a flowchart of the calculation of the color registration adjusting amount in the laser beam irradiating position. First, an amount of color misregistration DY in the sub scanning direction color registration toner pattern MA on the photosensitive drum 1 read by the on-photosensitive-drum registration detecting sensors 80X and 80Y is estimated (S1741). Further, an amount of color misregistration DX in the main scanning direction color registration toner pattern MB on the photosensitive drum 1 read by the on-photosensitive-drum registration detecting sensors 80X and 80Y is estimated (S1742). Similarly, an amount of color misregistration IY in the sub scanning direction color registration toner pattern MA on the intermediate transfer belt 91 read by the on-intermediate-transfer-belt registration detecting sensors 81X and 81Y is estimated (S1743). Further, an amount of misregistration IX in the main scanning direction color registration toner pattern MB on the intermediate transfer belt 91 read by the on-intermediate-transfer-belt registration detecting sensors 81X and 81Y is estimated (S1744). Then, differences IDY=IY−DY and IDX=IX−DX between the amounts of color misregistration estimated by the on-photosensitive-drum registration detecting sensors 80X, 80Y and the on-intermediate-transfer-belt registration detecting sensors 81X, 81Y, are calculated, respectively, and the differences IDY and IDX between the amounts of color misregistration are stored in the storage device 105 (S1745). Further, the color registration adjusting amounts IY and IX in the laser beam irradiating position are stored in the storage device 105 (S1746). Accordingly, the calculation of the color registration adjusting amount in the laser beam irradiating position is ended.

As illustrated in FIG. 18, after the color registration adjusting amount in the laser beam irradiating position is calculated (S174), the image signal is corrected with the color registration adjusting amounts IY and IX stored in the storage device 105 (S175). Thus, the downtime color registration is ended.

As illustrated in FIG. 14, after the downtime color registration (S17) is ended, it is checked whether or not the downtime color registration is the control to be performed when the power source of the image forming apparatus 100 is turned on (S18). In the case where the downtime color registration is the control to be performed when the power source of the image forming apparatus 100 is turned on (YES in S18), the CPU 103 turns off output signals of the charging high voltage source 101, the developing high voltage source 106, and the primary transfer high voltage source 93 (S19). After that, the CPU 103 turns off the photosensitive drum drive unit 19 and the intermediate transfer belt drive unit 20 (S20), and the downtime color registration sequence is ended. On the other hand, in the case where the downtime color registration is the control to be performed when image formation is performed on the predetermined number of transfer materials S (NO in S18), it is not necessary to turn off the output signal of each power source and each unit, and hence, the steps S19 and S20 are omitted, and the downtime color registration sequence is ended.

Color Registration Sequence in Image Formation

The color registration sequence in image formation in which color registration is performed immediately before image formation in the embodiment will be hereinafter described.

Figure 20:
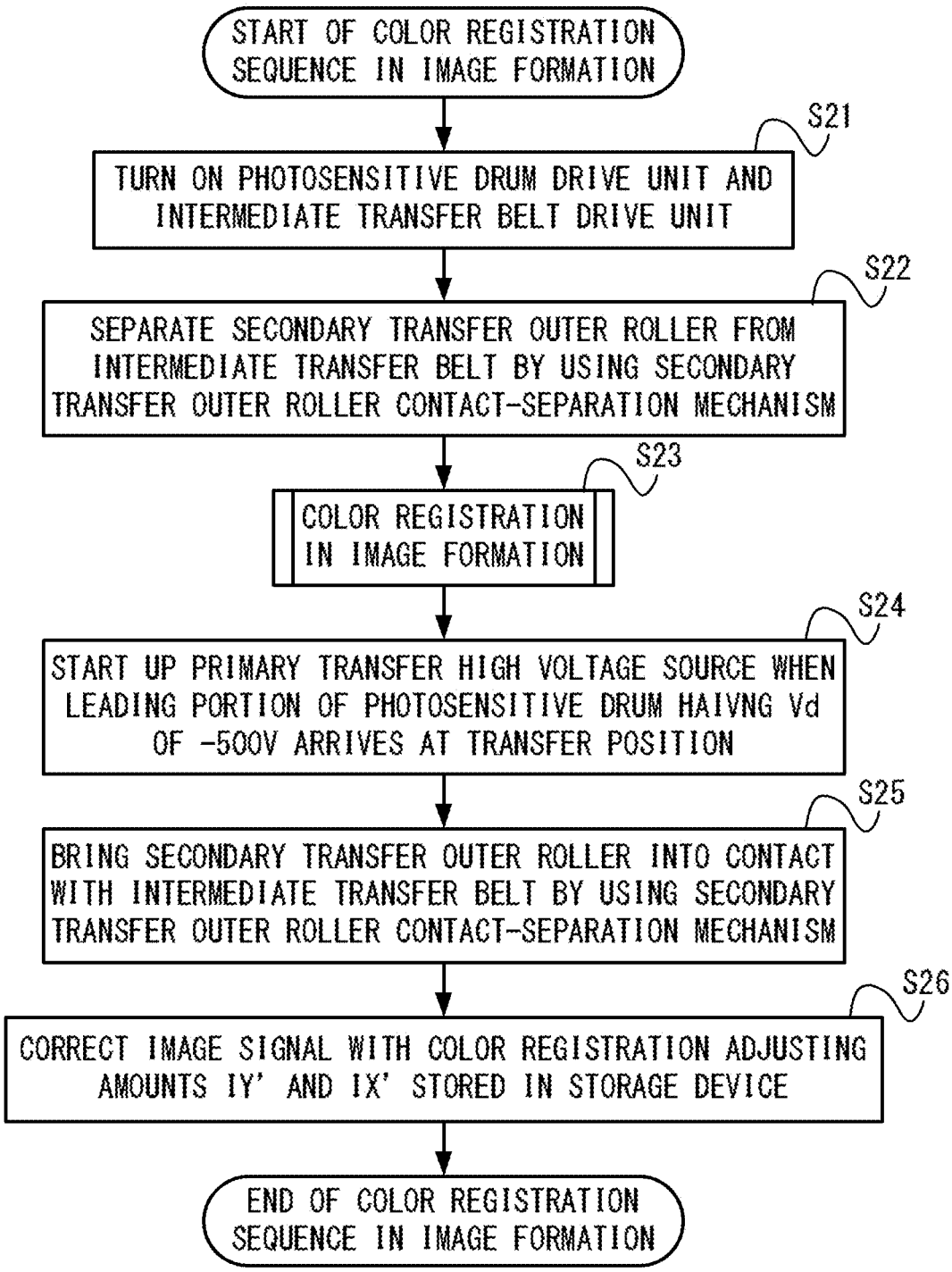
FIG. 20 is a flowchart of color registration sequence in image formation performed in the image forming apparatus 100 according to the first embodiment.

FIG. 20 is a flowchart of the color registration sequence in image formation. First, the CPU 103 turns on the photosensitive drum drive unit 19 and the intermediate transfer belt drive unit 20 (S21). Then, the CPU 103 separates the secondary transfer outer roller 96 from the intermediate transfer belt 91 by using the secondary transfer outer roller contact-separation mechanism 96*a* so that the color registration toner pattern on the intermediate transfer belt 91 does not contaminate the secondary transfer outer roller 96 (S22). Then, the color registration in image formation is performed (S23).

Figure 21:
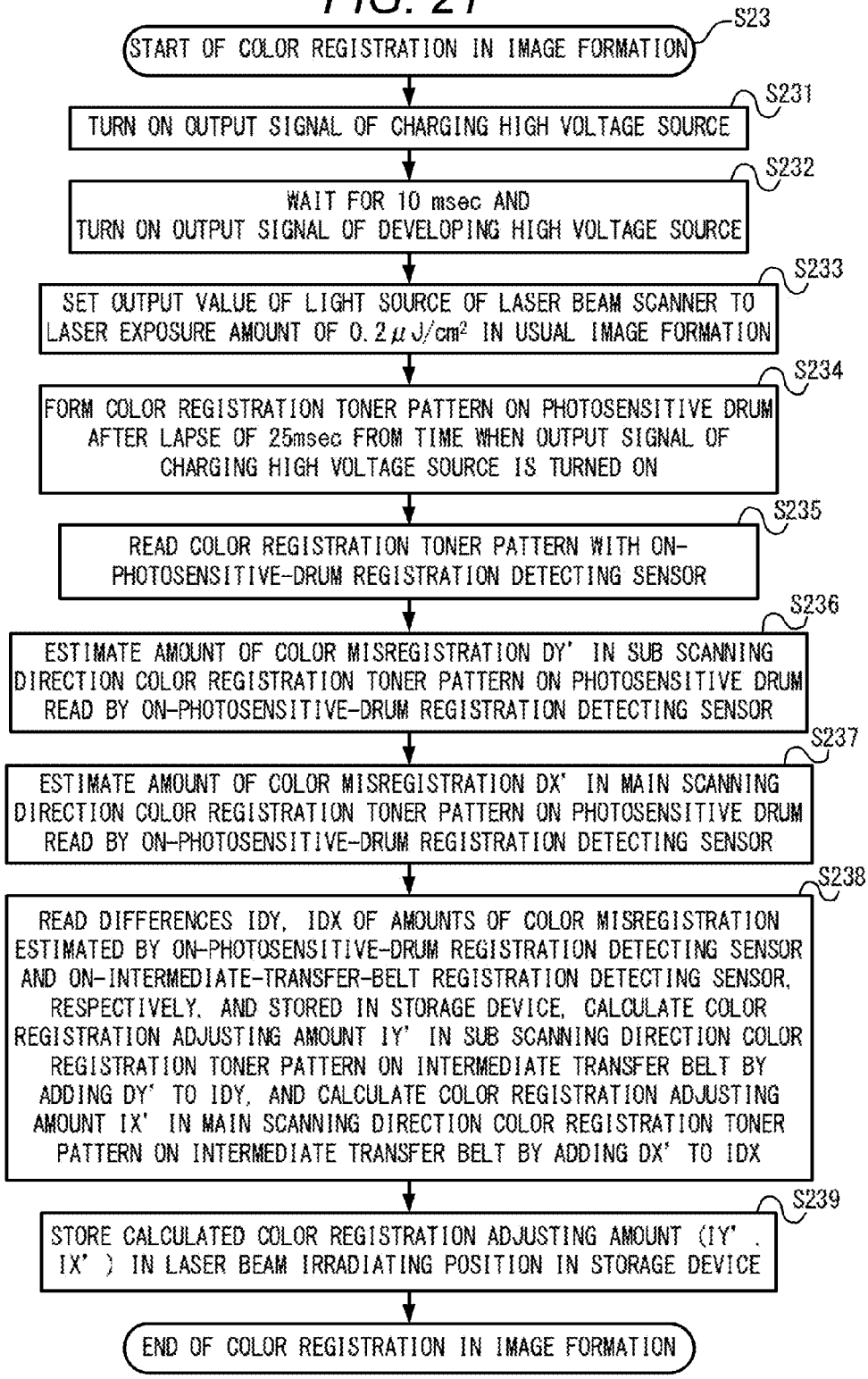
FIG. 21 is a flowchart of color registration in image formation performed in the image forming apparatus 100 according to the first embodiment.
Figure 22:
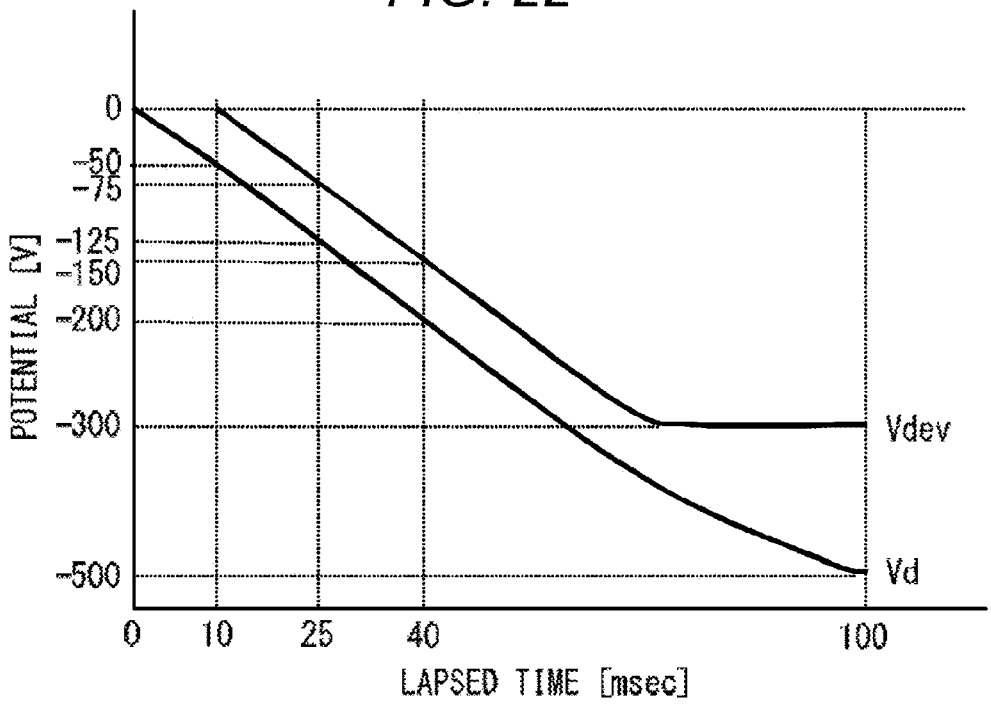

FIG. 21 is a flowchart of the color registration in image formation. First, the CPU 103 turns on an output signal of the charging high voltage source 101 (S231). After that, in order to prevent a fogging phenomenon on the photosensitive drum 1, the CPU 103 waits until the surface potential $V_d$ in the non-exposure portion of the photosensitive drum 1 reaches −50 V and turns on an output signal of the developing high voltage source 106 (S232). FIG. 22 shows a change in the surface potential $V_d$ in the non-exposure portion of the photosensitive drum 1 and the DC voltage $V_{dev}$ of the developing bias voltage with respect to lapsed time. Note that, in the embodiment, the DC voltage $V_{dc}$ and the AC voltage $V_{ac}$ of the charging bias voltage are applied simultaneously. Further, the DC voltage $V_{dev}$ and the AC voltage $V_{dev_ac}$ of the developing bias voltage are also applied simultaneously. Thus, the surface potential $V_d$ in the non-exposure portion changes substantially in the same way as the DC voltage $V_{dc}$, except for the rising time of 1 msec of the AC voltage $V_{ac}$ shown in FIG. 7B. Thus, as shown in FIG. 22, the time period required for the surface potential $V_d$ in the non-exposure portion to reach −50 V is 10 msec after the time (lapsed time=0) when the charging high voltage source 101 is turned on. Further, as shown in FIG. 22, when the developing high voltage source 106 is turned on, the DC voltage $V_{dev}$ starts changing, and at that time, the change in the DC voltage $V_{dev}$ is controlled so that the fog removal potential $V_{back}$ (=$V_{dev}$−$V_d$) is kept at 50 V. This is because, when the fog removal potential $V_{back}$ of 50 V is not ensured, toner is developed also in the non-exposure portion of the photosensitive drum 1, and hence, it becomes difficult to distinguish the exposure portion from the non-exposure portion. Further, care is required for the following: when an absolute value of the surface potential $V_d$ of the photosensitive drum 1 does not become large to some degree, toner is developed over the entire surface of the photosensitive drum 1, and hence, the exposure portion and the non-exposure portion cannot be distinguished from each other.

Next, the output value of the light source 3*a* of the exposure device 3 is set to be the laser exposure amount of 0.2 μJ/cm$^2$ in usual image formation determined by the laser exposure amount control illustrated in FIG. 16 (S233).

Next, the color registration toner pattern is formed on the photosensitive drum 1 (S234). The timing for forming the color registration toner pattern is determined as follows.

Figure 23:
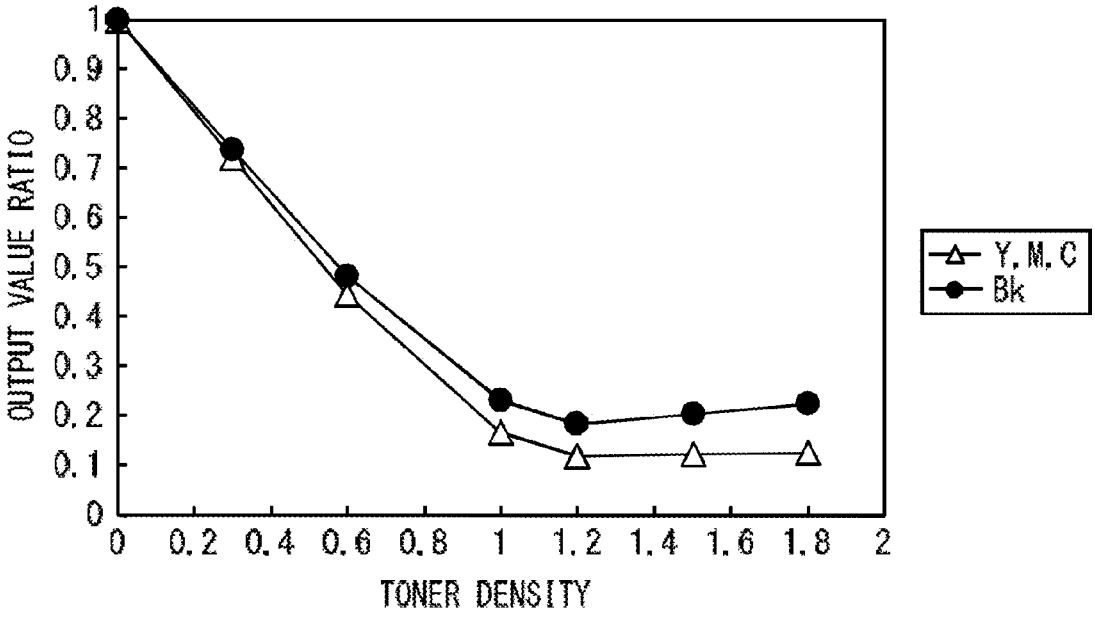
FIG. 23 is a graph showing a change in an output value ratio of a regular reflection light amount and a scattered light amount with respect to a toner density in the image forming apparatus 100 according to the first embodiment.

FIG. 23 shows a change in the output value ratio of the regular reflection light amount and the scattered light amount with respect to the toner density. Herein, the output value ratio of the regular reflection light amount and the scattered light amount at a time when the toner density is 0 is standardized to be 1. As shown in FIG. 23, it is understood that as the density of toner on a surface to be measured increases, the output value ratio of the regular reflection light amount and the scattered light amount decreases temporarily, and then increases.

In the embodiment, as a result of a study, it has been found that the output value ratio cannot be measured at a toner density of 0.85 or more irrespective of the color of toner because the signal is buried in underlying noise. Thus, in the embodiment, the toner density required for enabling the output value ratio of the regular reflection light amount and the scattered light amount to be measured sufficiently without causing the signal to be buried in underlying noise and for enabling distinction between the exposure portion and the non-exposure portion is set to be 0.3 or more. In order to develop an electrostatic latent image on the photosensitive drum 1 with a toner density of 0.3, as shown in FIG. 9A, the contrast potential $V_{cont}$ of 50 V is required. Thus, the relationships: $V_{back}$=$V_{dev}$−$V_d$=50 V and $V_{cont}$=$V_L$−$V_{dev}$=50 V, and the relationship between the laser exposure amount and the surface potential $V_L$ in the exposure portion of the photosensitive drum 1 shown in FIG. 5 only need to be satisfied simultaneously. It is understood that, for this purpose, at 0.2 μJ/cm$^2$ that is the laser exposure amount in usual image formation, it is only required that the surface potential $V_d$ in the non-exposure portion be set to be −125 V, the DC voltage $V_{dev}$ of the developing bias voltage be set to be −75 V, and the surface potential $V_L$ in the exposure portion be set to be −25 V. As shown in FIG. 22, it is understood that the time when the surface potential $V_d$ and the DC voltage $V_{dev}$ in the non-exposure portion reach −125 V and −75 V, respectively, is 25 msec after the turn-on (lapsed time=0) of the output signal of the charging high voltage source 101. Thus, the color registration pattern only needs to be formed at timing when 25 msec have lapsed.

As shown in FIG. 22, the time period required for rising of the charging high voltage source 101 in the embodiment, specifically, the time period required until the surface potential $V_d$ in the non-exposure portion of the photosensitive drum 1 reaches −500 V is 100 msec. On the other hand, as described above, in the embodiment, the color registration toner pattern can be formed 25 msec after the turn-on of the output signal of the charging high voltage source 101 at the earliest. Specifically, according to the embodiment, within the time period until the charging high voltage source 101 and the developing high voltage source 106 are started up, the color registration toner pattern can be formed on the photosensitive drum 1.

Specifically, within a period from the time (lapsed time=25 msec) when the color registration toner pattern is enabled to be formed to the time (lapsed time=100 msec) when the charging high voltage source 101 is started up, the color registration toner pattern can be formed. Specifically, in the embodiment, the process speed of the photosensitive drum 1 is 300 mm/sec, and hence, the color registration toner pattern can be formed on the photosensitive drum 1 in a region of 300 mm/sec×(0.1−0.025) sec=22.5 mm. Therefore, in the embodiment, the color registration toner pattern having a width of 9.7 mm and a length of 18.0 mm illustrated in FIG. 17B is used. Then, the CPU 103 forms color registration toner patterns in positions at a distance of 40 mm from both the ends of the photosensitive drum 1 so that the positions of the color registration toner patterns are matched with the positions of the two on-photosensitive-drum registration detecting sensors 80X and 80Y.

As shown in FIG. 8A, the time period required for starting up the developing high voltage source 106 in the embodiment is 10 msec in the case where no control is performed, which is sufficiently shorter than the start-up time period of 100 msec of the charging high voltage source 101. However, as described above, in order to prevent toner from being developed in the non-exposure portion of the photosensitive drum 1, the CPU 103 changes the DC voltage $V_{dev}$ of the developing bias voltage to −300 V so as to keep the fog removal voltage $V_{back}$=$V_{dev}$−$V_d$ to be 50 V. Then, after the DC voltage $V_{dev}$ of the developing bias voltage reaches −300 V, the CPU 103 sets the surface potential $V_d$ in the non-exposure portion of the photosensitive drum 1 to be −500 V while keeping the DC voltage $V_{dev}$ constant.

After the color registration toner pattern is formed on the photosensitive drum 1, the color registration toner patterns formed by the on-photosensitive-drum registration detecting sensors 80X and 80Y are read (S235). Then, the CPU 103 as an arithmetic device performs the following calculation. Specifically, an amount of color misregistration DY' in the read sub scanning direction color registration toner pattern MA on the photosensitive drum 1 is estimated (S236), and further, an amount of color misregistration DX' in the read main scanning direction color registration toner pattern MB on the photosensitive drum 1 is estimated (S237). Next, the differences IDY (=IY−DY) and IDX (=IX−DX) between the amounts of color misregistration stored in the storage device 105 in S1745 illustrated in FIG. 19 are read, respectively. Then, by adding the amounts of color misregistration DY' and DX' to the differences IDY and IDX, a color registration adjusting amount IY' in the sub scanning direction color registration toner pattern on the intermediate transfer belt 91 and a color registration adjusting amount IX' in the main scanning direction color registration toner pattern are calculated, respectively (S238). The calculated color registration adjusting amounts IY' and IX' in the laser beam irradiating positions are stored in the storage device 105 (S239). Thus, the color registration in image formation is ended.

In the color registration in image formation of the embodiment, when the color registration toner pattern is formed on the photosensitive drum 1, the predetermined laser exposure amount is radiated. However, the color registration toner pattern may be formed while the laser exposure amount is changed, with reference to a table or the like formed in advance.

Next, as illustrated in FIG. 20, when a leading portion of the photosensitive drum 1 in which the surface potential $V_d$ in the non-exposure portion of the photosensitive drum 1 has reached −500 V arrives at the transfer position "d", the primary transfer high voltage source 93 is started up (S24). Then, the secondary transfer outer roller 96 is brought into contact with the intermediate transfer belt 91 by using the secondary transfer outer roller contact-separation mechanism 96*a* (S25). After that, the CPU 103 corrects the image signal with the color registration adjusting amounts IY' and IX' in the laser beam irradiating positions stored in the storage device 105, and thus serves as the second control device (S26). Thus, the color registration sequence in image formation is ended. After that, image formation is started.

Accordingly, in the embodiment, within the time period until the charging high voltage source 101 and the developing high voltage source 106 are started up, the color registration sequence in image formation can be performed.

Second Embodiment

Next, color registration in a second embodiment of the present invention will be described. The color registration in the embodiment is the same as that in the first embodiment except for the color registration sequence in image formation, and hence, the description thereof is omitted.

Color Registration Sequence in Image Formation in Second Embodiment

Figure 24:
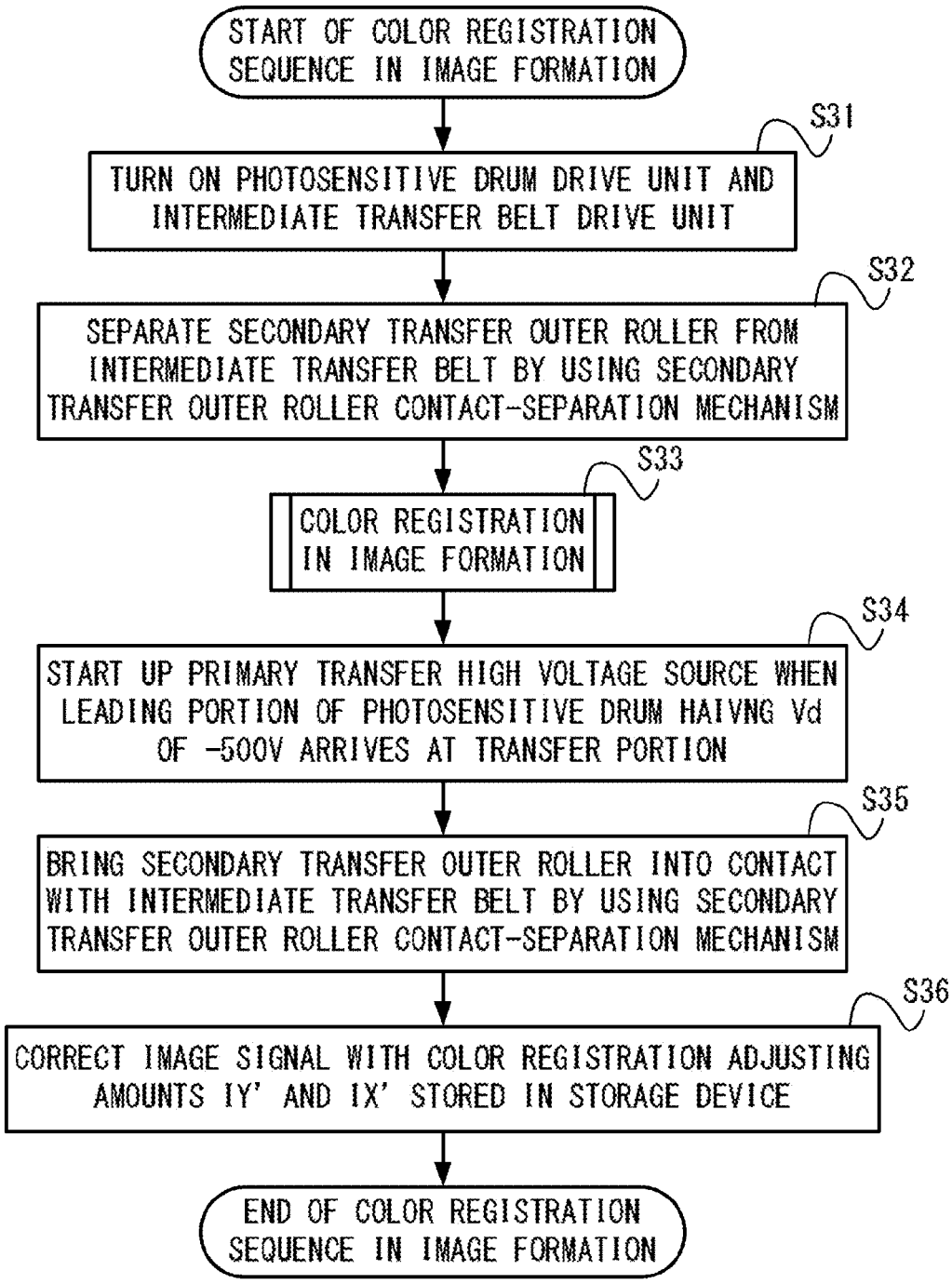
FIG. 24 is a flowchart of color registration sequence in image formation performed in an image forming apparatus 100 according to a second embodiment of the present invention.

FIG. 24 is a flowchart of the color registration sequence in image formation in the embodiment. First, the CPU 103 turns on the photosensitive drum drive unit 19 and the intermediate transfer belt drive unit 20 (S31). Then, the CPU 103 separates the secondary transfer outer roller from the intermediate transfer belt 91 by using the secondary transfer outer roller contact-separation mechanism 96*a* so that a color registration toner pattern on the intermediate transfer belt 91 does not contaminate the secondary transfer outer roller 96 (S32). Then, the color registration in image formation is performed (S33).

Figure 25:
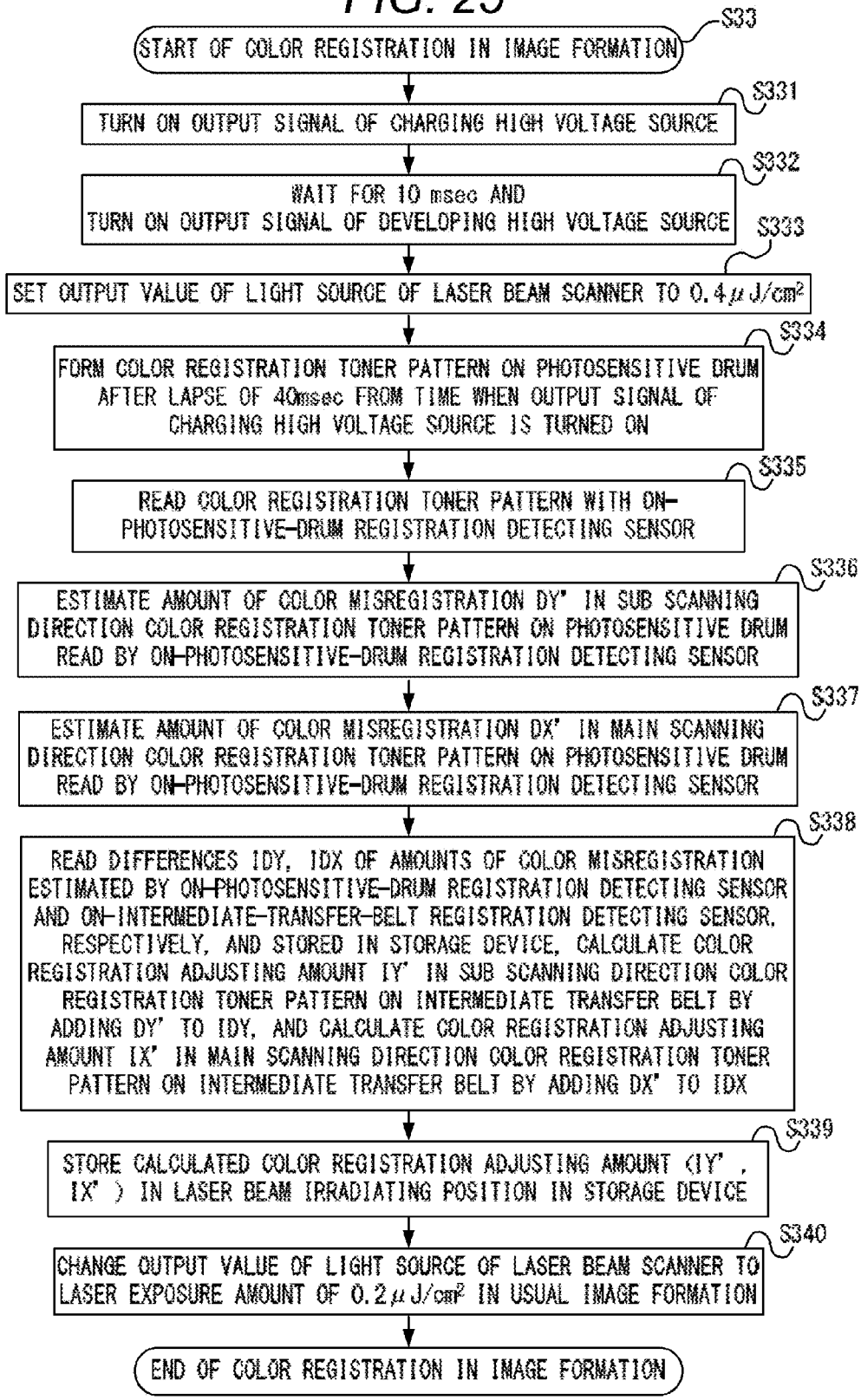
FIG. 25 is a flowchart of color registration in image formation performed in the image forming apparatus 100 according to the second embodiment.

FIG. 25 is a flowchart of the color registration in image formation. First, the CPU 103 turns on an output signal of the charging high voltage source 101 (S331). After that, in order to prevent a fogging phenomenon on the photosensitive drum 1, the CPU 103 waits until the surface potential $V_d$ in the non-exposure portion of the photosensitive drum 1 reaches −50 V and turns on an output signal of the developing high voltage source 106 (S332). As shown in FIG. 22, the time period required for the surface potential $V_d$ to reach −50 V is 10 msec after the time (lapsed time=0) when the charging high voltage source 101 is turned on.

In the case where there is a flaw on the surface of the photosensitive drum 1, the output value ratio of the on-photosensitive-drum registration detecting sensor 80 may become small. Considering such erroneous measurement, it is desired that the output value ratio in the exposure portion be as small as possible. Referring to FIG. 23, it is understood that, in the image forming apparatus 100 of the present invention, the output value ratio between the exposure portion and the non-exposure portion of the photosensitive drum 1 decreases monotonously until a toner density of 1.1, and at a toner density larger than 1.1, the output value ratio becomes substantially constant. Thus, when the toner density is 1.1 or more, the influence of the erroneous measurement resulting from a flaw on the surface of the photosensitive drum 1 can be eliminated.

On the other hand, when the pattern having a width of 9.7 mm and a length of 18.0 mm illustrated in FIG. 17B is used as the color registration toner pattern also in the embodiment, a time period of 60 msec (=18.0 mm÷300 mm/sec) is required for forming the pattern. Specifically, in order to form the color registration toner pattern by the time of 100 msec at which the charging high voltage source 101 and the developing high voltage source 106 are started up, the formation of the pattern needs to be started 40 msec after the turn-on of the output signal of the charging high voltage source 101. Referring to FIG. 22, at lapsed time of 40 msec, the surface potential $V_d$ in the non-exposure portion of the photosensitive drum 1 is −200 V, and the DC voltage $V_{dev}$ of the developing bias voltage is −150 V. In the color registration in image formation in the first embodiment, the output value of the light source 3*a* of the exposure device 3 is set to be the laser exposure amount of 0.2 μJ/cm$^2$ in usual image formation determined by the laser exposure amount control illustrated in FIG. 16. Thus, similarly, in the case where the output value of the light source 3*a* of the exposure device 3 in the embodiment is set to be 0.2 μJ/cm$^2$, the surface potential $V_L$ in the exposure portion of the photosensitive drum 1 becomes −40 V, as shown in FIG. 5. As a result, due to the relationship: $V_{cont}=V_L-V_{dev}$, the contrast potential $V_{cont}$ becomes 110 V, and the toner density at that time becomes 0.7 as shown in FIG. 9A. Specifically, when the output value of the light source 3*a* of the exposure device 3 is set to be the laser exposure amount of 0.2 μJ/cm$^2$ in usual image formation, the toner density becomes 0.7, which does not satisfy the toner density of 1.1 required for eliminating the influence of the erroneous measurement resulting from a flaw on the surface of the photosensitive drum 1.

To address this, the output value of the light source 3*a* of the exposure device 3 is set to be a maximum value of 0.4 μJ/cm$^2$, which is larger than the laser exposure amount of 0.2 μJ/cm$^2$ in usual image formation. In this case, at the surface potential $V_d$ of −200 V in the non-exposure portion of the photosensitive drum 1 and the DC voltage $V_{dev}$ of −150 V of the developing bias voltage, the surface potential $V_L$ in the exposure portion of the photosensitive drum 1 becomes −10 V as shown in FIG. 5. As a result, it is understood that the contrast potential $V_{cont}$ becomes 140 V (=−10 V−(−150 V)), and the toner density at that time becomes 1.1 as shown in FIG. 9A.

Based on the above-mentioned description, in the color registration in image formation in the embodiment, the output value of the light source 3*a* of the exposure device 3 is set to be the laser exposure amount of 0.4 μJ/cm$^2$ which is different from that in usual image formation (S333).

Then, after 40 msec have lapsed from the turn-on of the output signal of the charging high voltage source 101, the color registration toner pattern is formed on the photosensitive drum 1 (S334). The formed color registration toner pattern is read by the on-photosensitive-drum registration detecting sensor 80 (S335).

Then, the CPU 103 as an arithmetic device performs the following calculation. Specifically, an amount of color misregistration DY' in the read sub scanning direction color registration toner pattern MA on the photosensitive drum 1 is estimated (S336). Further, an amount of color misregistration DX' in the read main scanning direction color registration toner pattern MB on the photosensitive drum 1 is estimated (S337). Next, the differences IDY (=IY−DY) and IDX (=IX−DX) between the amounts of color misregistration stored in the storage device 105 in S1745 illustrated in FIG. 19 are read, respectively. Then, by adding the amounts of color misregistration DY' and DX' to the differences IDY and IDX, a color registration adjusting amount IY' in the sub scanning direction color registration toner pattern on the intermediate transfer belt 91 and a color registration adjusting amount IX' in the main scanning direction color registration toner pattern are calculated, respectively (S338). The calculated color registration adjusting amounts IY' and IX' in the laser beam irradiating positions are stored in the storage device 105 (S339).

Then, the output value of the light source 3*a* of the exposure device 3 is changed to the laser exposure amount of 0.2 $\mu J/cm^2$ in usual image formation (S340). Accordingly, the color registration in image formation is ended.

In the color registration in image formation of the embodiment, when the color registration toner pattern is formed on the photosensitive drum 1, the predetermined laser exposure amount is radiated. However, the color registration toner pattern may be formed while a laser exposure amount is changed, with reference to a table or the like formed in advance.

Next, as illustrated in FIG. 24, when a leading portion of the photosensitive drum 1 in which the surface potential $V_d$ in the non-exposure portion of the photosensitive drum 1 has reached −500 V arrives at the transfer position "d", the primary transfer high voltage source 93 is started up (S34). Then, the secondary transfer outer roller 96 is brought into contact with the intermediate transfer belt 91 by using the secondary transfer outer roller contact-separation mechanism 96*a* (S35). After that, the CPU 103 corrects the image signal with the color registration adjusting amounts IY' and IX' in the laser beam irradiating positions stored in the storage device 105, and thus serves as the second control device (S36). Thus, the color registration sequence in image formation is ended. After that, image formation is started.

Accordingly, in the embodiment, within the time period until the charging high voltage source 101 and the developing high voltage source 106 are started up, the color registration sequence in image formation can be performed.

The present invention is described with reference to the image forming apparatus 100 of a four-station tandem drum type including the photosensitive drums 1 of four colors (yellow, magenta, cyan, and black). However, the present invention is not limited thereto and can also be used preferably in, for example, a monochromic image forming apparatus including only one black photosensitive drum, which requires accurate color registration. Further, the present invention can also be used preferably in an image forming apparatus including more than four photosensitive drums.

The present invention is also described with reference to the image forming apparatus 100 including one charging roller 2 for each color as a charging device. However, as a matter of course, the present invention can also be used in an image forming apparatus including a plurality of charging rollers for each color. Further, the present invention can also be used in an image forming apparatus using a non-contact type charging device as a charging device.

In the present invention, the laser beam irradiating position is adjusted by reflecting the color registration adjusting amount stored in the storage device 105 in a software manner to perform image exposure. However, the laser beam irradiating position can also be adjusted by moving the position and the like of a lens (optical element) in the exposure device 3, that is, by a method of making the adjustment in a hardware manner.

Further, in the present invention, as the charging bias voltage generated by the charging high voltage source 101 and the developing bias voltage generated by the developing high voltage source 106, voltages in which a DC voltage and an AC voltage in a sine wave are superimposed on each other are used. However, the present invention can also be used preferably in an image forming apparatus which applies only a DC voltage, as long as a sufficient developing property is ensured.

The color registration sequence in image formation in the present invention may be performed at each start time of image formation or at any start time of image formation.

Thus, according to the present invention, within the time period until usual image formation becomes possible to be performed, that is, within the time period until the charging high voltage source 101 and the developing high voltage source 106 are started up, the color registration sequence can be performed. Specifically, compared with the case of a conventional image forming apparatus where the color registration sequence is performed after usual image formation becomes possible to be performed, the time period required for performing the color registration sequence can be shortened, and hence the FCOT can be shortened.

According to the embodiments, before usual image formation becomes possible to be performed, a color registration electrostatic latent image for adjusting color registration can be formed on the surface of the image bearing member. Thus, compared with the case of the conventional image forming apparatus where color registration is performed after usual image formation becomes possible to be performed, the time period required for color registration can be shortened, and hence the FCOT can be shortened.

The present invention can be used preferably in an image forming apparatus or the like of an electrophotographic system or an electrostatic recording system.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-193899, filed Sep. 6, 2011, which is hereby incorporated by reference herein in its entirety.

What is claimed is:

1. An image forming apparatus, comprising:

an image bearing member;

a charging device configured to charge a surface of the image bearing member;

a power source configured to apply a voltage to the charging device;

an exposure device configured to irradiate the surface of the image bearing member with a light beam to form an electrostatic latent image;

a developing device configured to develop the electrostatic latent image into a toner image; and a reading device configured to read a color registration toner image developed by the developing device, wherein in a case of formation of an output image, the exposure device emits the light beam for forming the image after a surface potential of the image bearing member reaches a predetermined potential, and in a case of formation of the color registration toner image after the power source is started up, the exposure device starts to emit the light beam for forming the color registration toner image before the surface potential of the image bearing member reaches the predetermined potential.

2. An image forming apparatus according to claim 1, further comprising:

an intermediate transfer member;

a transfer device configured to transfer the toner image on the image bearing member to the intermediate transfer member;

another reading device configured to read the color registration toner image transferred from the image bearing member to the intermediate transfer member by the transfer device; and a control device configured to obtain a color registration adjusting amount based on an output from the reading device and an output from the other reading device.

3. An image forming apparatus according to claim 2, wherein the control device obtains a difference in an amount of color misregistration between the color registration toner image on the image bearing member and the color registration toner image on the intermediate transfer member based on the output from the reading device and the output from the other reading device and stores the difference in the amount of the color misregistration in a storage device.

4. An image forming apparatus according to claim 3, wherein the control device obtains the color registration adjusting amount based on the output from the reading device and the difference in the amount of the color misregistration stored in the storage device immediately before image formation.

5. An image forming apparatus according to claim 2, wherein the control device controls an output timing of the light beam from the exposure device or a position of an optical element in the exposure device based on the color registration adjusting amount, to correct the color misregistration.

6. An image forming apparatus according to claim 1, wherein the exposure device forms the color registration electrostatic latent image on the image bearing member at an exposure amount different from an exposure amount in the formation of the output image.

7. An image forming apparatus according to claim 1, wherein in case of formation of the color registration toner image after the power source is started up, the exposure device starts to emit the light beam for forming the color registration toner image after a predetermined time elapses from a startup of the power source.

* * * * *